US010589444B2

(12) United States Patent
Sudo et al.

(10) Patent No.: US 10,589,444 B2
(45) Date of Patent: Mar. 17, 2020

(54) MIXER AND MIXING METHOD FOR GYPSUM SLURRY

(71) Applicant: YOSHINO GYPSUM CO., LTD., Tokyo (JP)

(72) Inventors: Ushio Sudo, Tokyo (JP); Wataru Nakamura, Tokyo (JP); Seigo Ishibashi, Tokyo (JP); Hirokuni Tani, Tokyo (JP)

(73) Assignee: YOSHINO GYPSUM CO., LTD., Tokyo (JP)

( * ) Notice: Subject to any disclaimer, the term of this patent is extended or adjusted under 35 U.S.C. 154(b) by 0 days.

(21) Appl. No.: 15/753,782

(22) PCT Filed: Aug. 26, 2015

(86) PCT No.: PCT/JP2015/073972
§ 371 (c)(1),
(2) Date: Feb. 20, 2018

(87) PCT Pub. No.: WO2017/033302
PCT Pub. Date: Mar. 2, 2017

(65) Prior Publication Data

US 2018/0243943 A1 Aug. 30, 2018

(51) Int. Cl.
*B28C 5/16* (2006.01)
*B01F 5/22* (2006.01)
(Continued)

(52) U.S. Cl.
CPC ..... *B28C 5/16* (2013.01); *B01F 3/1221* (2013.01); *B01F 5/221* (2013.01); *B01F 7/26* (2013.01);
(Continued)

(58) Field of Classification Search
CPC .... B01F 15/0266; B01F 7/26; B01F 15/0233; B01F 15/0276; B01F 15/0292;
(Continued)

(56) References Cited

U.S. PATENT DOCUMENTS 2,097,088 A 10/1937 Mills
3,529,936 A * 9/1970 Muller-Rid et al. .. B01F 7/1635 162/26
(Continued)

FOREIGN PATENT DOCUMENTS

DE 36 11 048 A1 10/1987
EP 1 637 302 A1 3/2006
(Continued)

OTHER PUBLICATIONS

Extended European Search Report dated Nov. 21, 2018 from European Patent Application No. 15902271.4, 8 pages.
(Continued)

*Primary Examiner* — Charles Cooley
(74) *Attorney, Agent, or Firm* — Staas & Halsey LLP

(57) ABSTRACT

A mixer has a circular housing defining a mixing area for mixing and kneading of a gypsum slurry. A rotary disc is positioned in the housing and rotated in a predetermined rotational direction. A rotary driving shaft cointegrally connected with the rotary disc and a plurality of scrapers are positioned in the mixing area. A slurry discharge port is provided on an annular wall of the housing for feeding the gypsum slurry of the mixing area onto a sheet of paper for gypsum board liner. An opening of the slurry discharge port is divided into a plurality of narrow openings, so that fluid resistance on the gypsum slurry flowing out of the mixing area is increased. An annular basal part rotates integrally with the rotary disc and an inner end portion of the scraper is fixed to the annular basal part.

28 Claims, 17 Drawing Sheets

(51) Int. Cl.

| | |
|---|---|
| ***B01F 3/12*** | (2006.01) |
| ***B28B 17/02*** | (2006.01) |
| ***B28B 19/00*** | (2006.01) |
| ***B28C 5/08*** | (2006.01) |
| ***B01F 15/02*** | (2006.01) |
| ***B01F 7/26*** | (2006.01) |

(52) U.S. Cl.
CPC ..... *B01F 15/0292* (2013.01); *B28B 17/023* (2013.01); *B28B 19/0092* (2013.01); *B28C 5/0818* (2013.01); *B28C 5/0881* (2013.01)

(58) Field of Classification Search
CPC .... B01F 15/0293; B01F 7/00766; B01F 3/12; B01F 3/1221; B01F 5/221; C04B 11/00; B28C 5/0881; B28C 5/1253; B28C 5/16; B28C 5/1269; B28C 5/006; B28C 5/06; B28C 5/0818; B28B 1/50; B28B 17/023; B28B 19/0092
USPC ..... 366/64, 96–99, 162.1, 6, 8, 18, 20, 35, 366/38, 51, 65, 102, 141, 168.1, 171.1, 366/172.1, 172.2, 181.7, 303–304, 366/315–317, 167.1–175.3, 183.2; 156/39, 44
See application file for complete search history.

(56) References Cited

U.S. PATENT DOCUMENTS

| | | | | |
|---|---|---|---|---|
| 4,176,972 | A * | 12/1979 | Stiling | B01F 7/00758 366/304 |
| 5,484,200 | A | 1/1996 | Bradshaw | |
| 6,059,444 | A | 5/2000 | Johnson et al. | |
| 6,193,408 | B1 * | 2/2001 | Miura | B01F 7/00758 366/304 |
| 7,690,834 | B2 * | 4/2010 | Nakamura | B01F 7/00766 156/39 |
| 9,856,168 | B2 * | 1/2018 | Ueno | B28C 5/16 |
| 2007/0008815 | A1 * | 1/2007 | Nakamura | B01F 7/00766 366/172.1 |
| 2015/0315074 | A1 * | 11/2015 | Ueno | B28C 5/16 106/680 |
| 2017/0008192 | A1 * | 1/2017 | Kawamura | B01F 7/00766 |
| 2018/0243943 | A1 * | 8/2018 | Sudo | B28B 17/023 |

FOREIGN PATENT DOCUMENTS

| | | | | |
|---|---|---|---|---|
| EP | 1637302 | A1 * | 3/2006 | B01F 7/00766 |
| JP | 43-24696 | | 10/1968 | |
| JP | 55-47128 | | 4/1980 | |
| JP | 2-12433 | | 1/1990 | |
| JP | 7-1437 | | 1/1995 | |
| JP | 11-314219 | | 11/1999 | |
| JP | 2000-6137 | | 1/2000 | |
| SU | 908610 | A1 | 2/1982 | |
| SU | 1368180 | A1 | 1/1988 | |
| WO | WO-9967074 | A1 * | 12/1999 | B28B 13/02 |
| WO | WO00/56435 | | 9/2000 | |
| WO | WO2004/103663 | | 12/2004 | |
| WO | WO-2017033302 | A1 * | 3/2017 | B28B 17/023 |

OTHER PUBLICATIONS

International Search Report dated Dec. 1, 2015 in corresponding International Patent Application No. PCT/JP2015/073972.
Japanese Office Action dated May 15, 2019 in corresponding Japanese Patent Application No. 2017-536127.
Translation of the Written Opinion of the International Searching Authority dated Dec. 1, 2015 in corresponding International Patent Application No. PCT/JP2015/073972.

* cited by examiner

【FIG. 1】
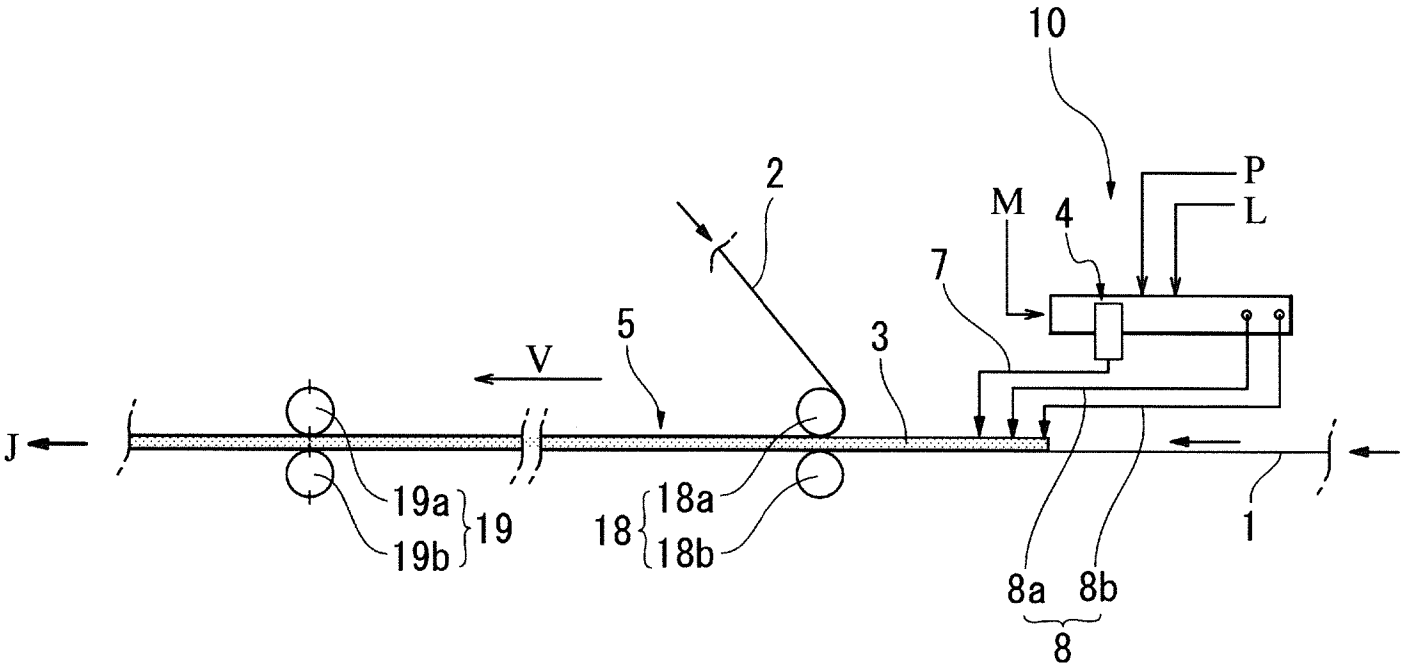

【FIG. 2】
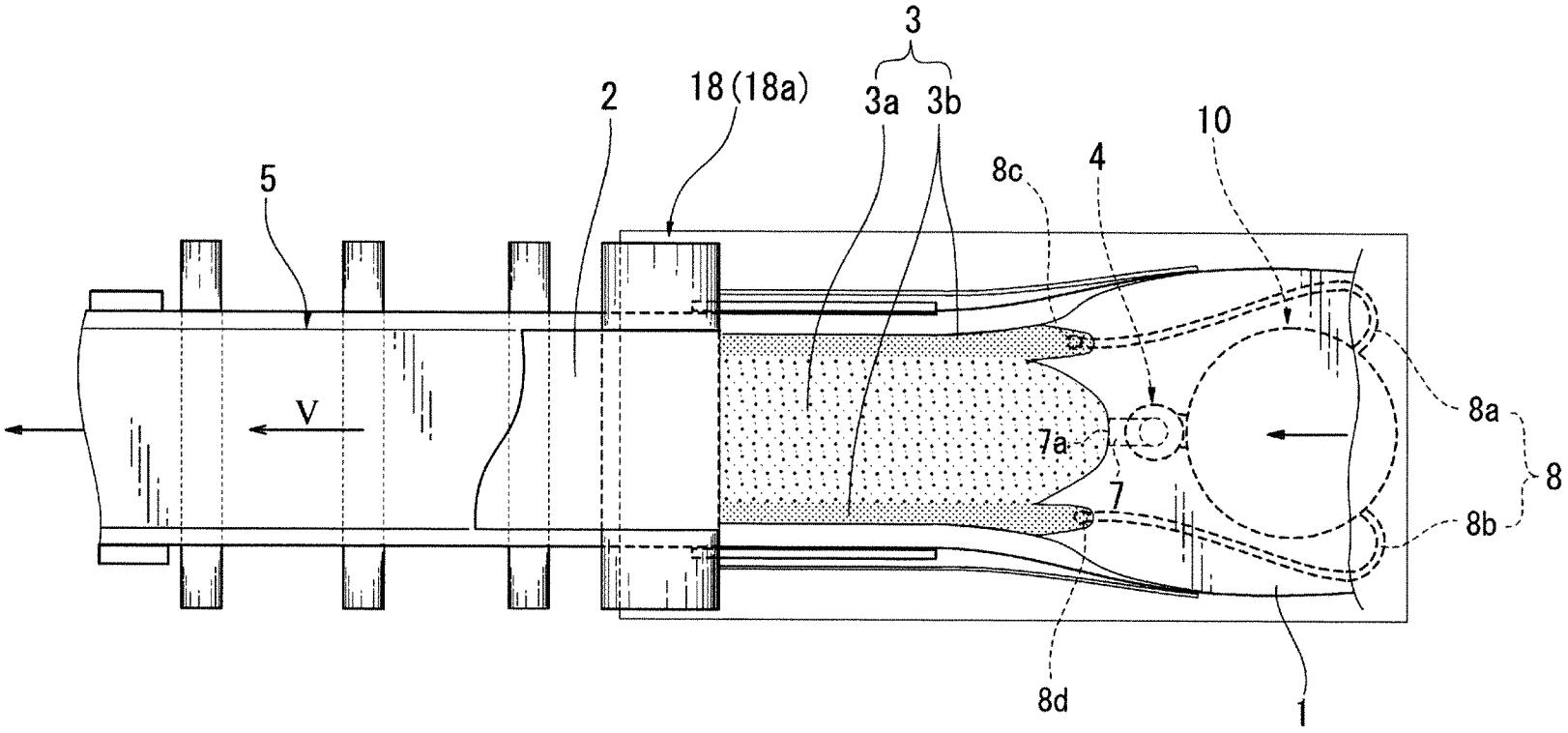

【FIG. 3】
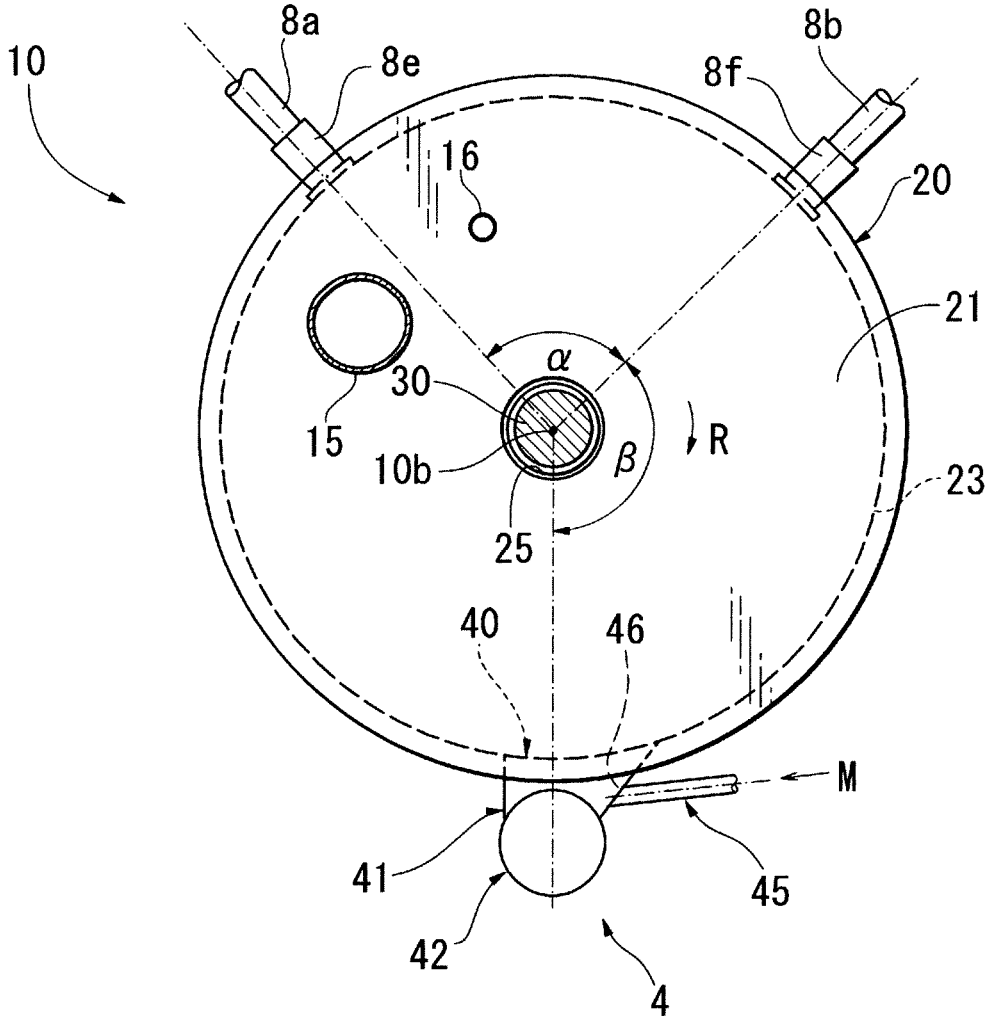

【FIG. 4】
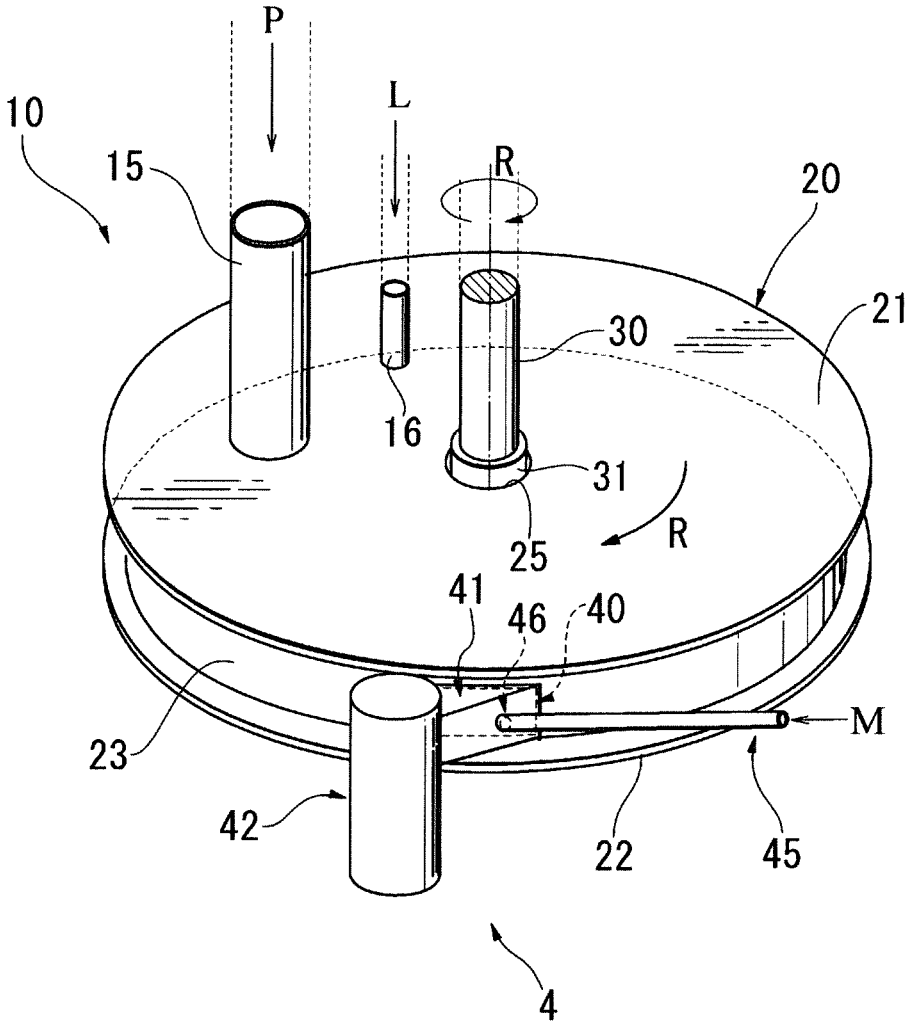

【FIG. 5】
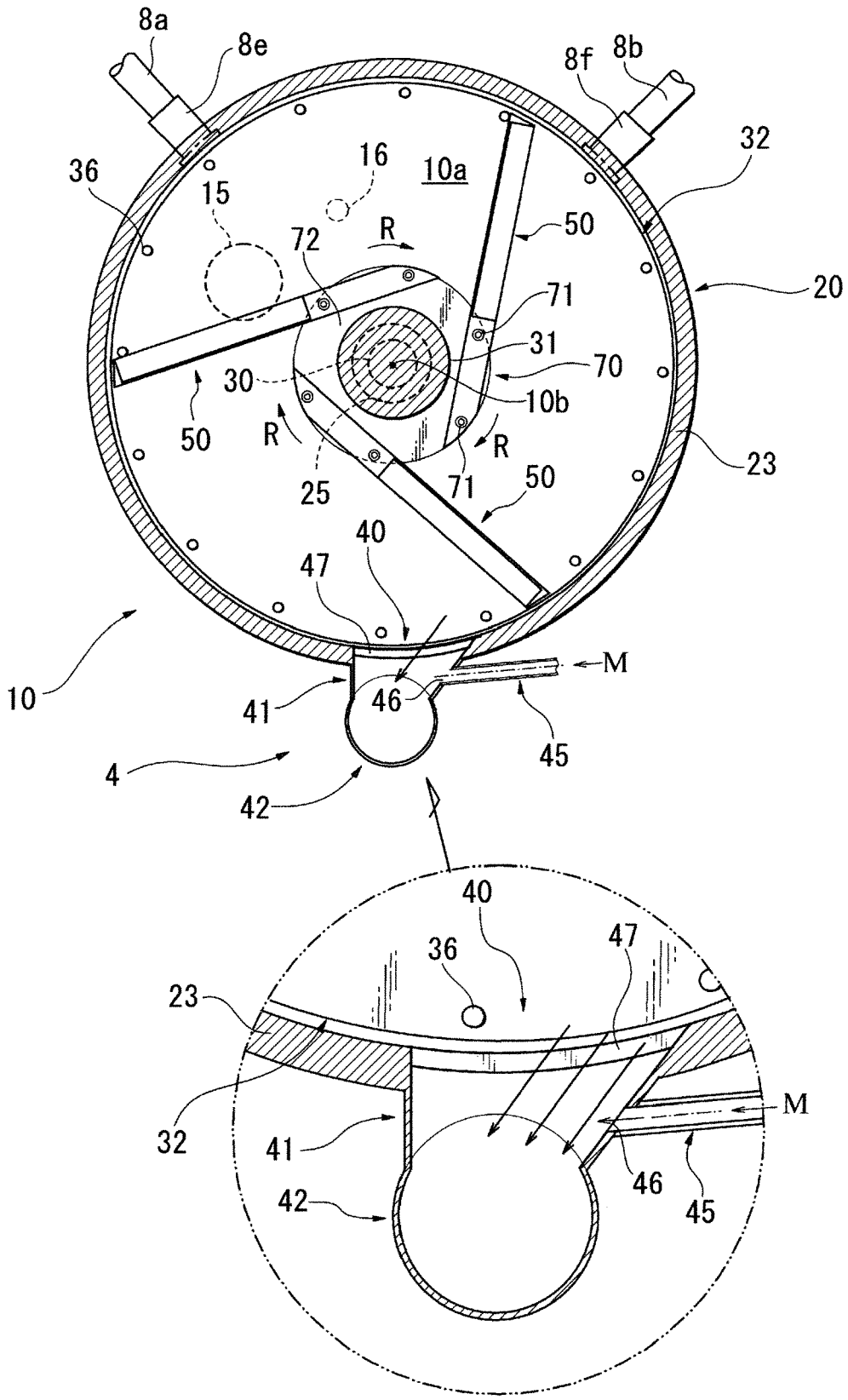

【FIG. 6】
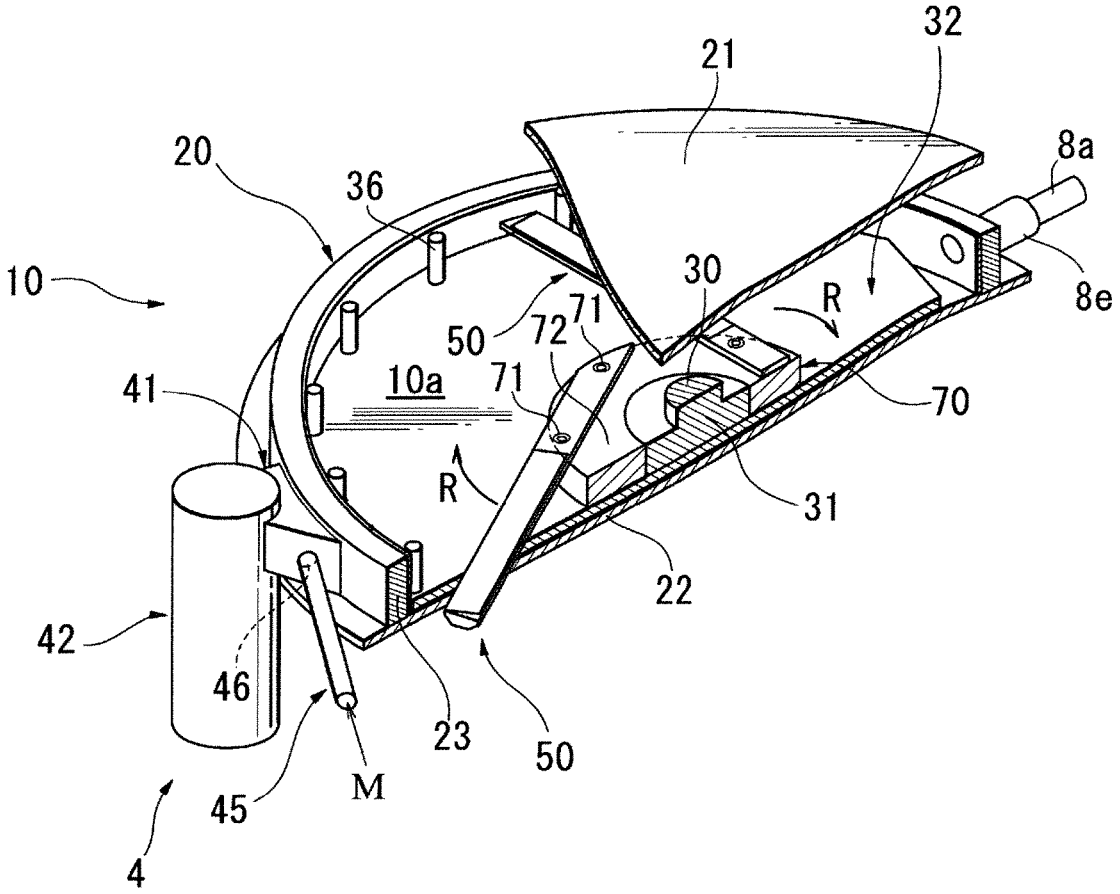

【FIG. 7】
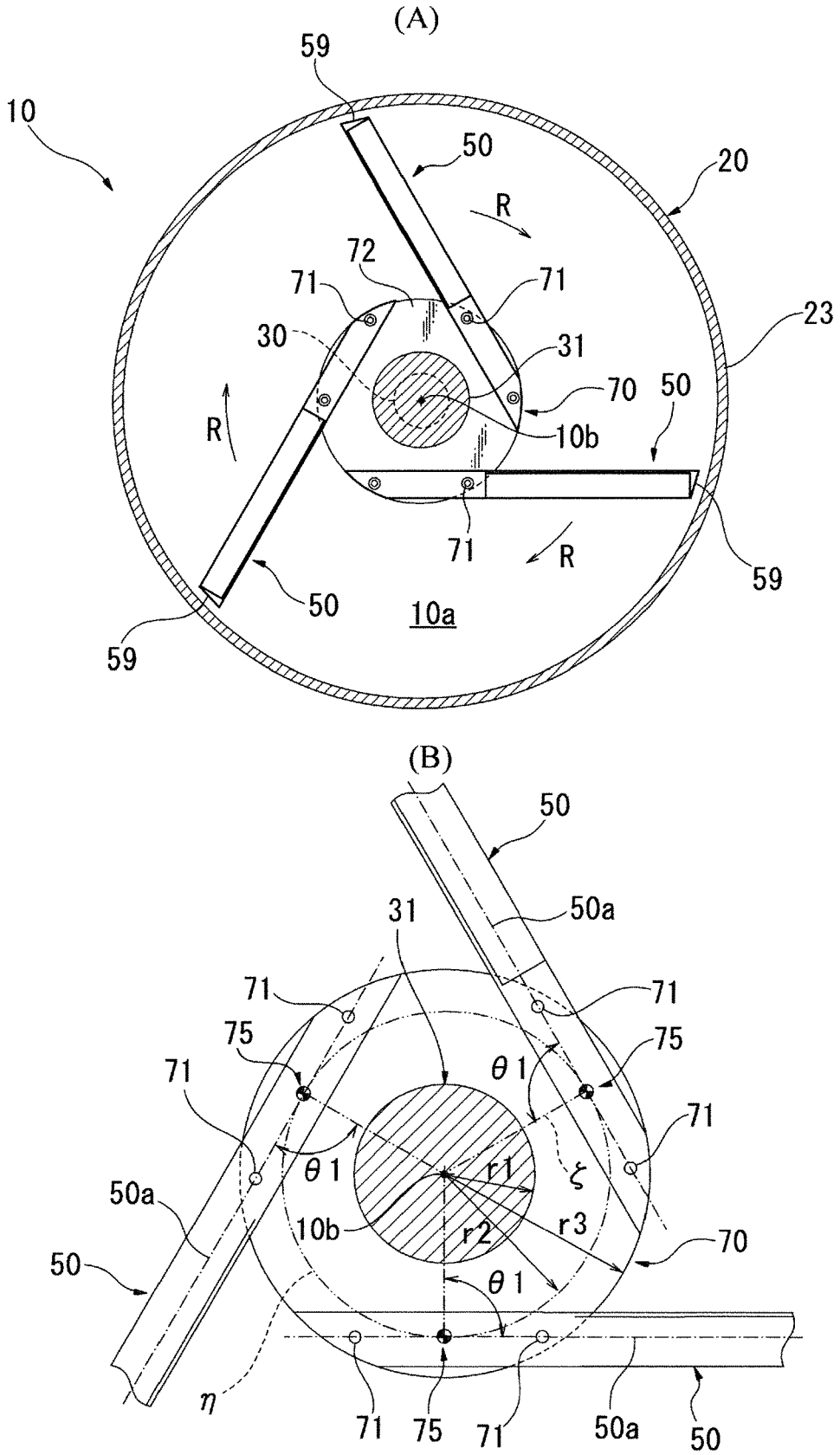

【FIG. 8】
(A)
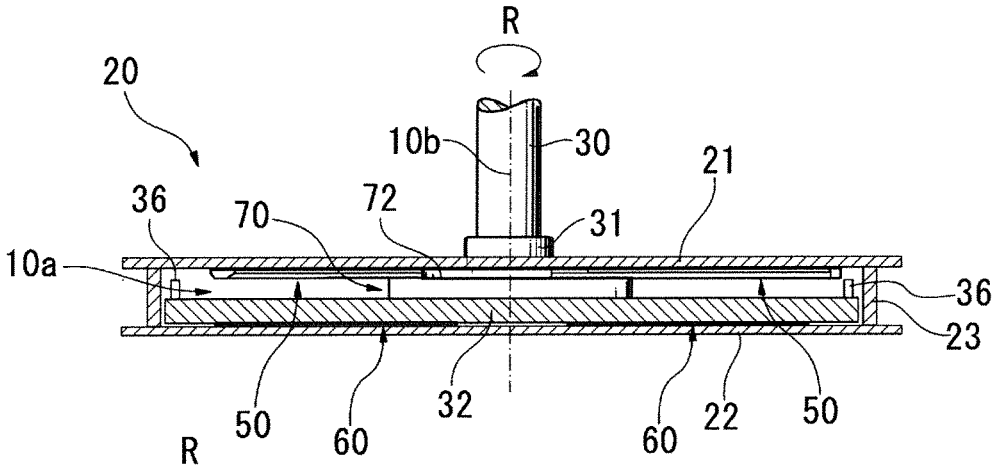
(B)
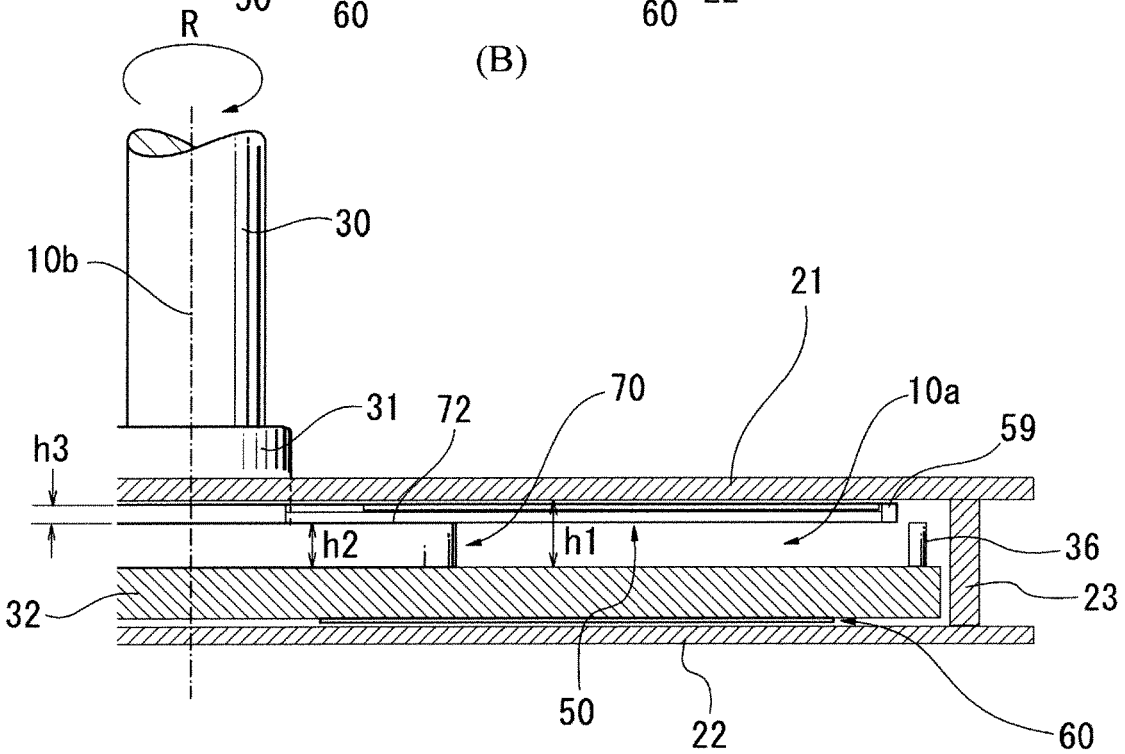
(C)
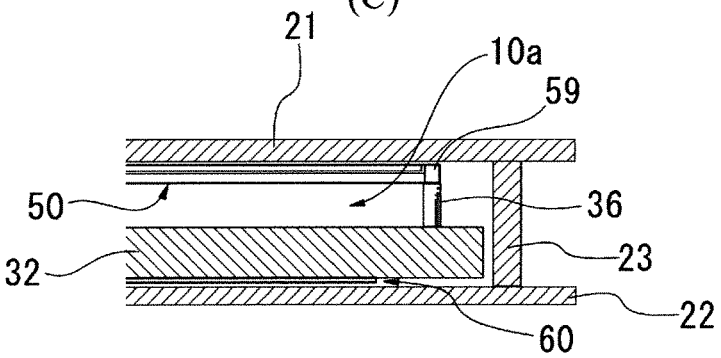

【FIG. 9】
(A)
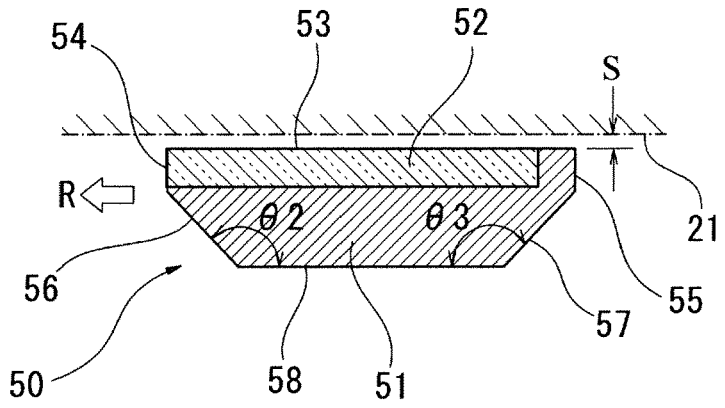
(B)
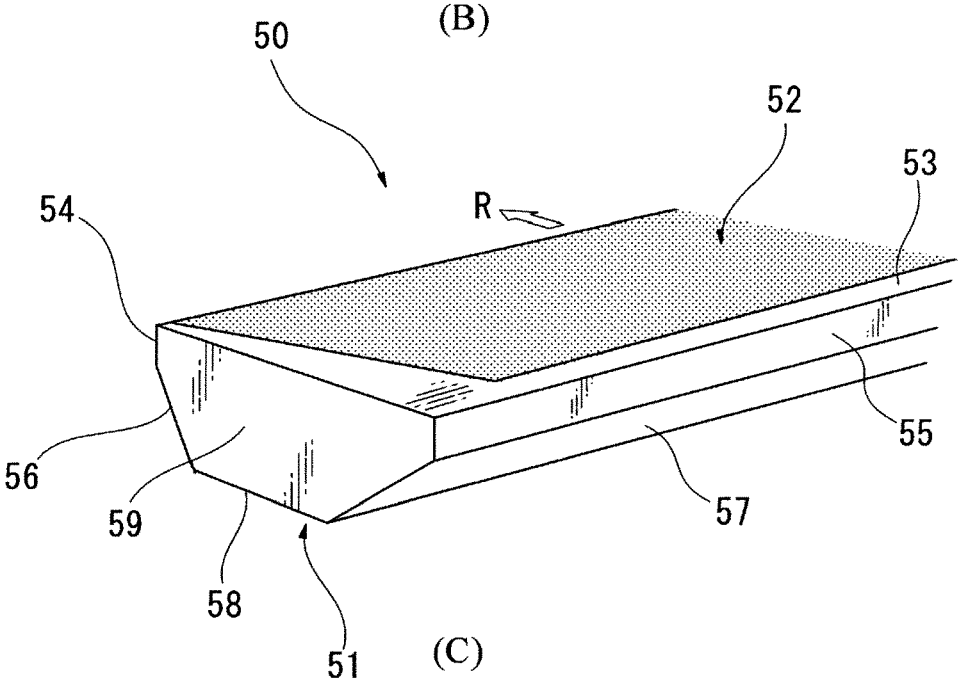
(C)
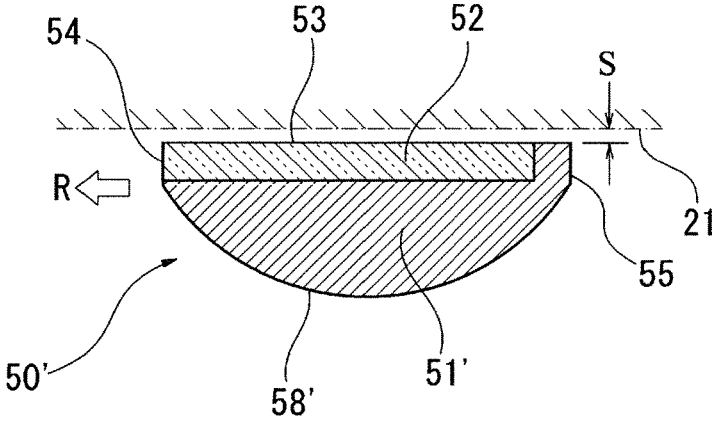

【FIG. 10】
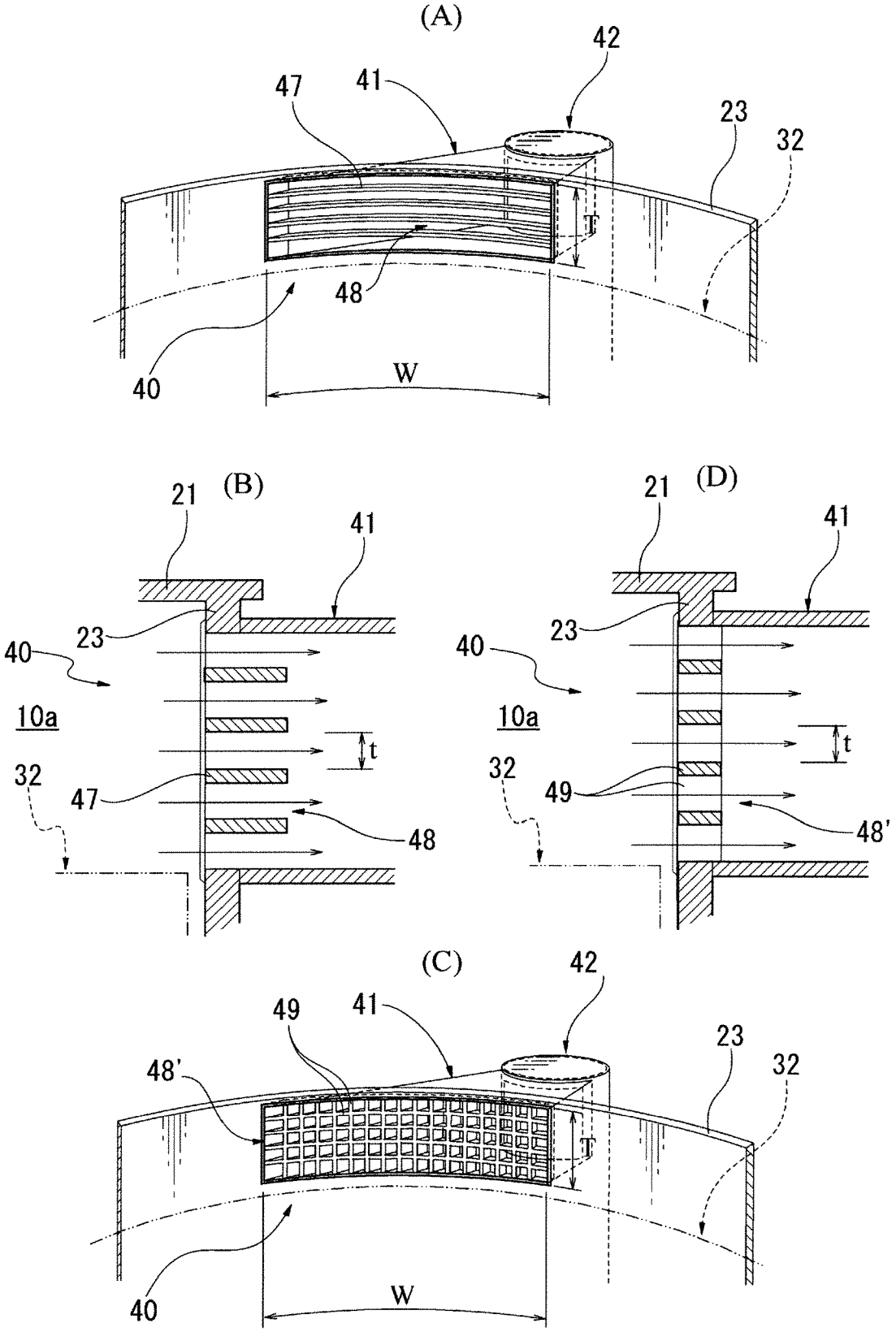

【FIG. 11】
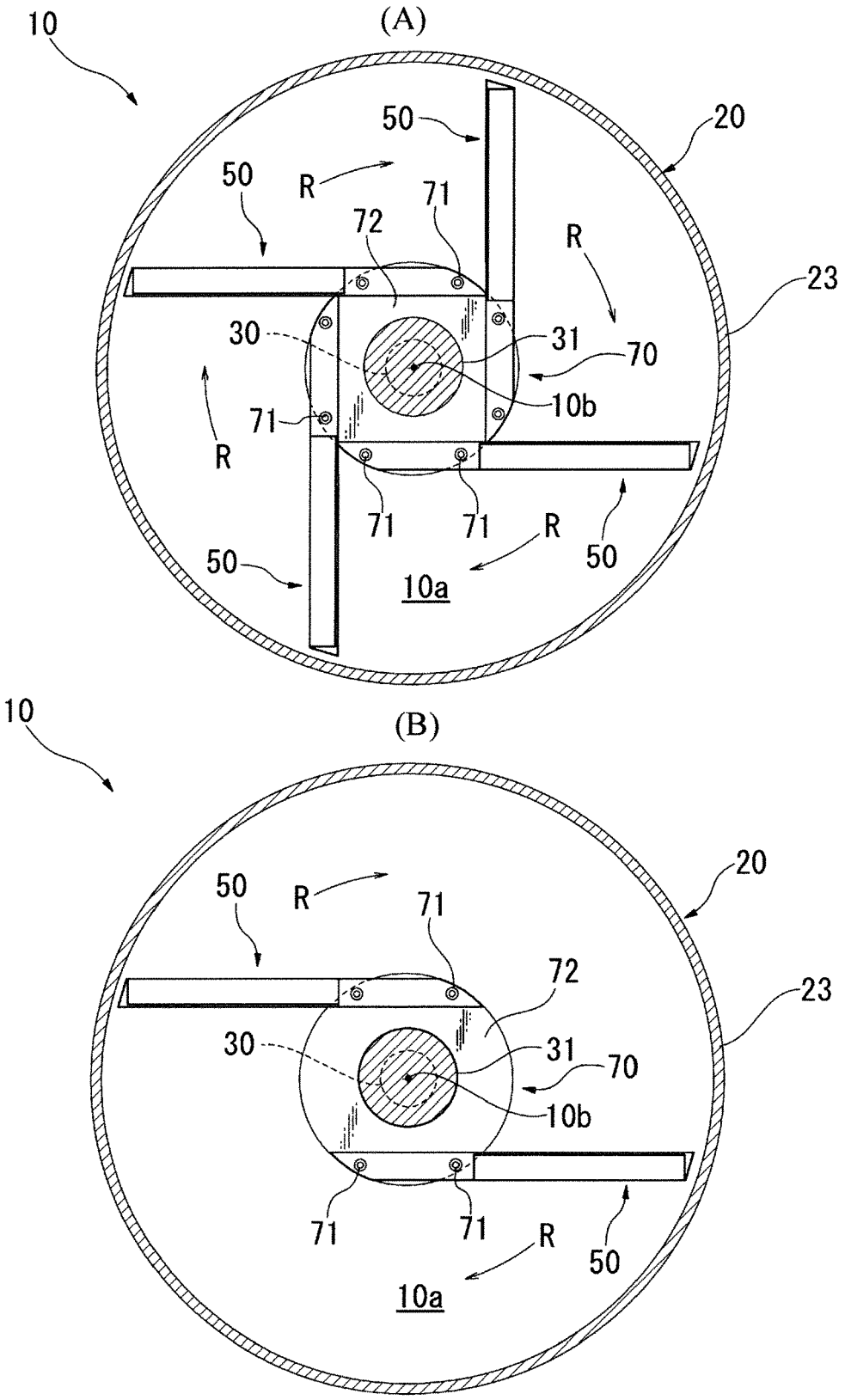

【FIG. 12】
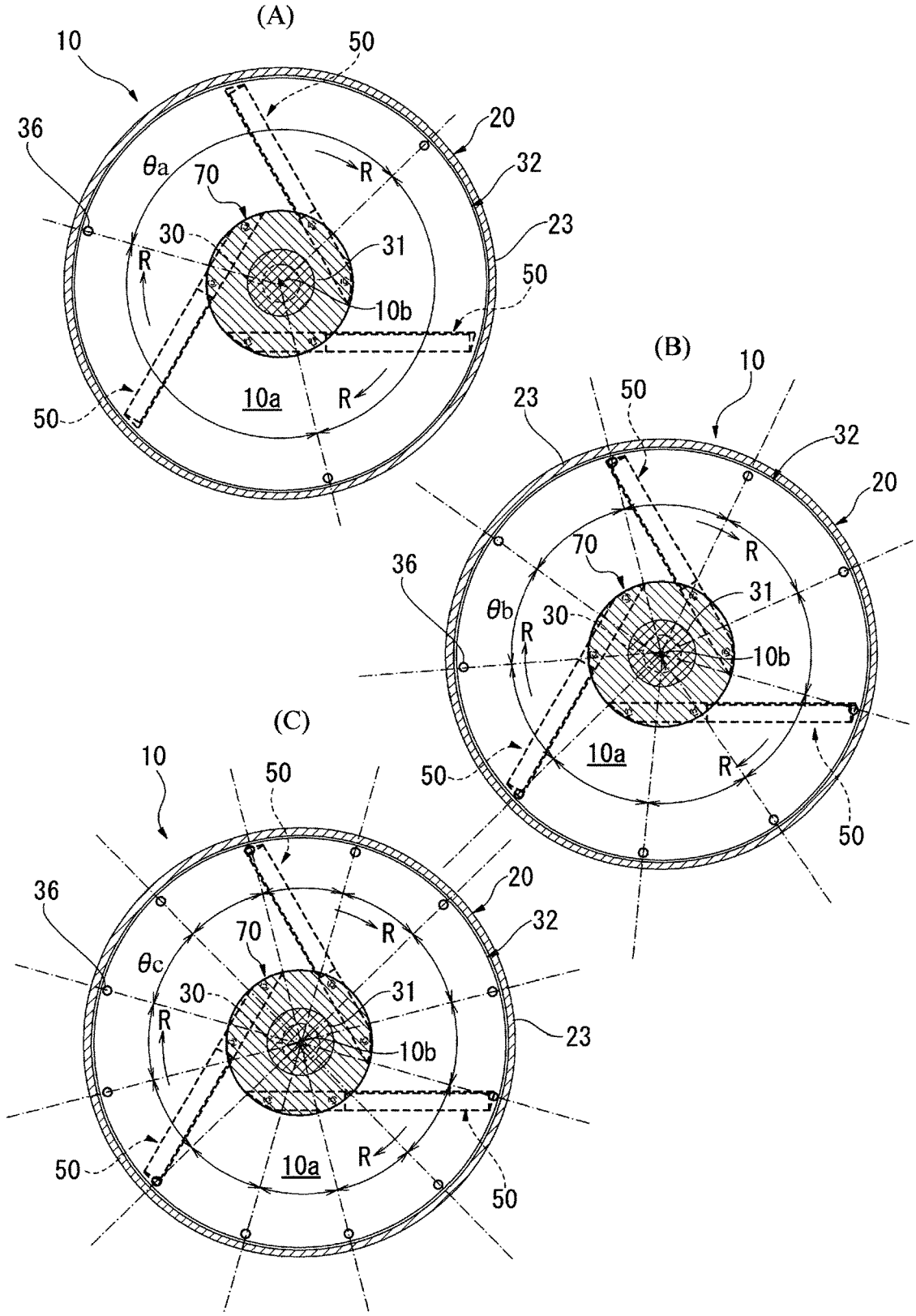

【FIG. 13】
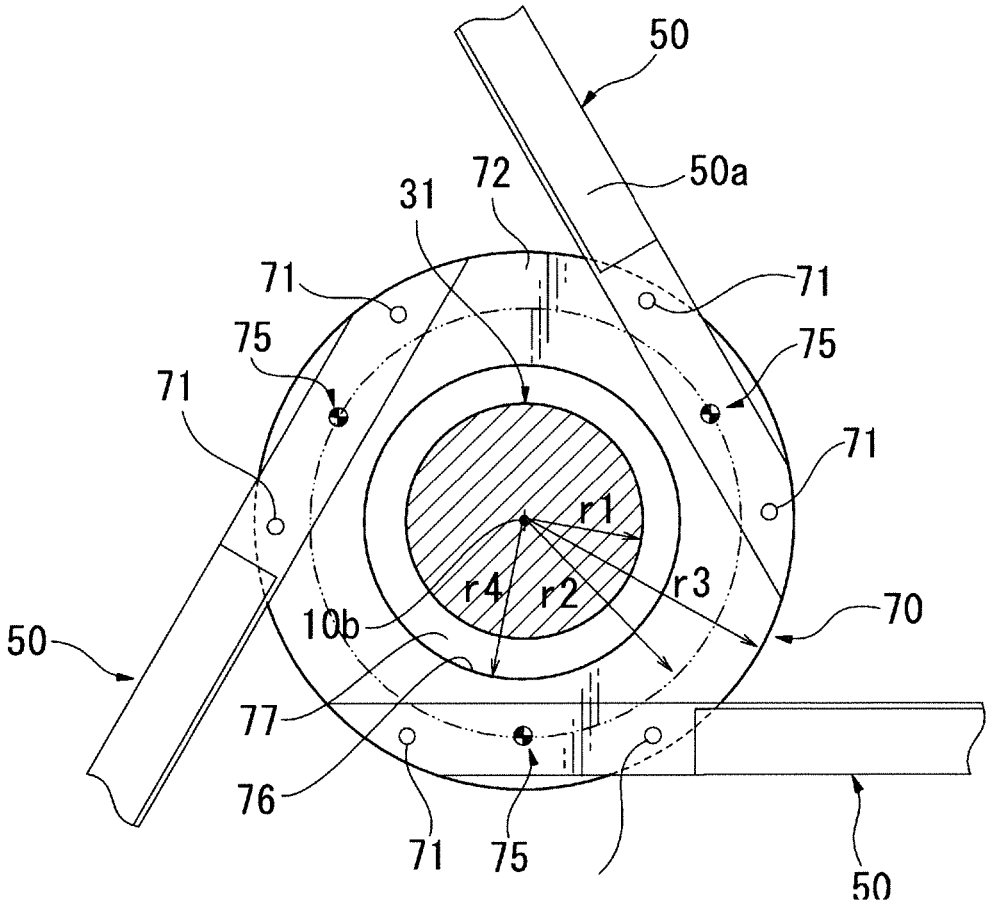

【FIG. 14】
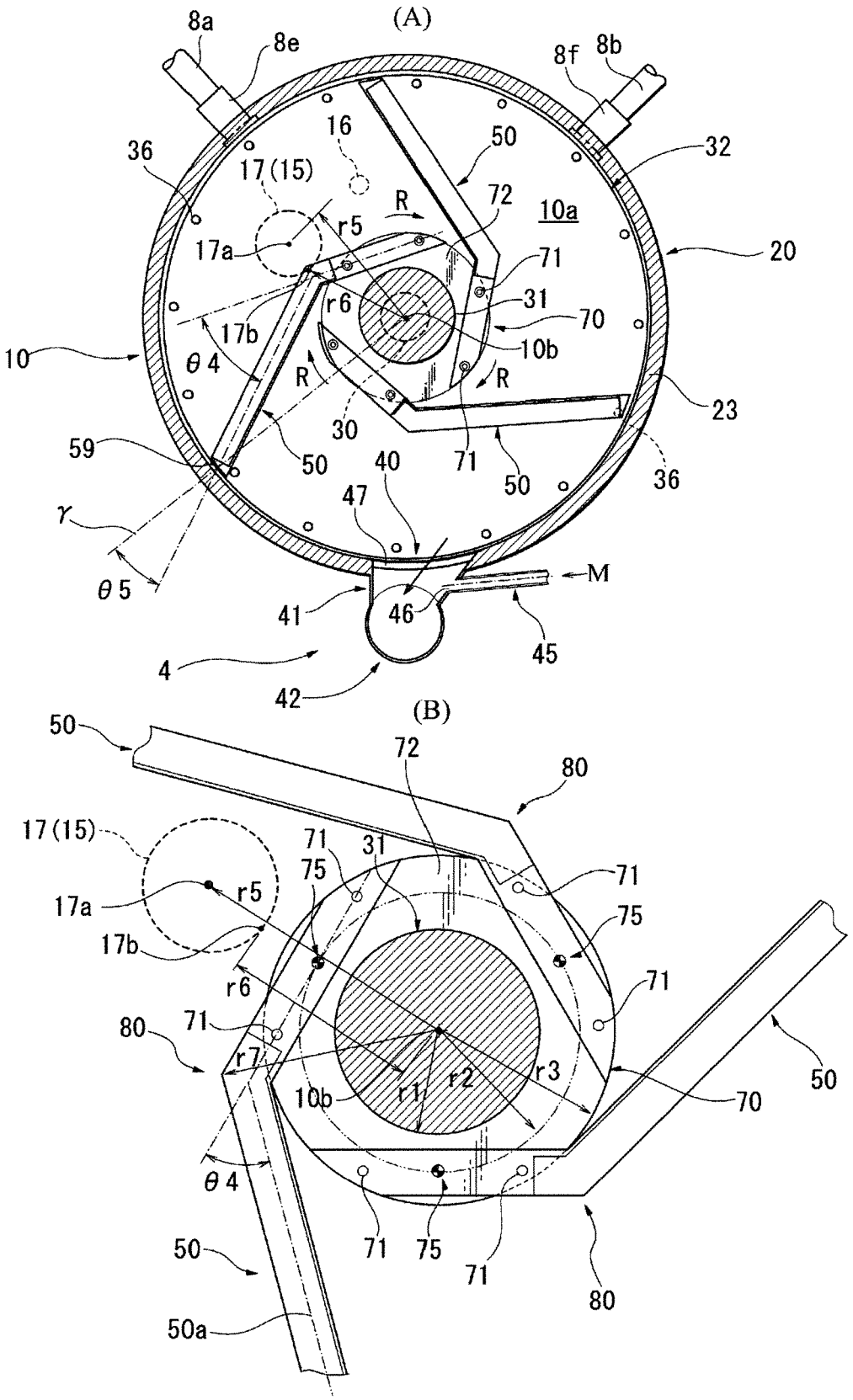

【FIG. 15】
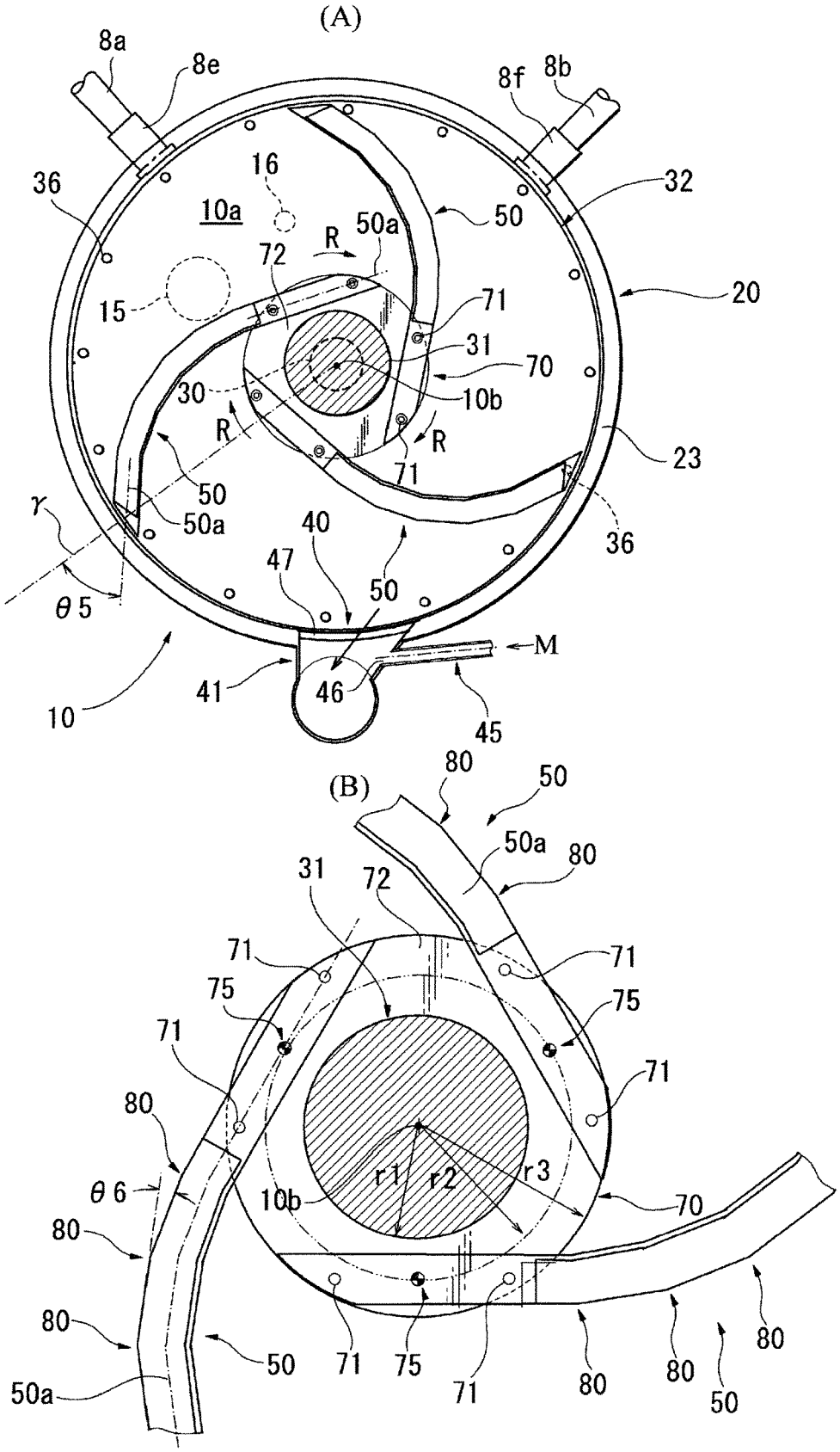

【FIG. 16】
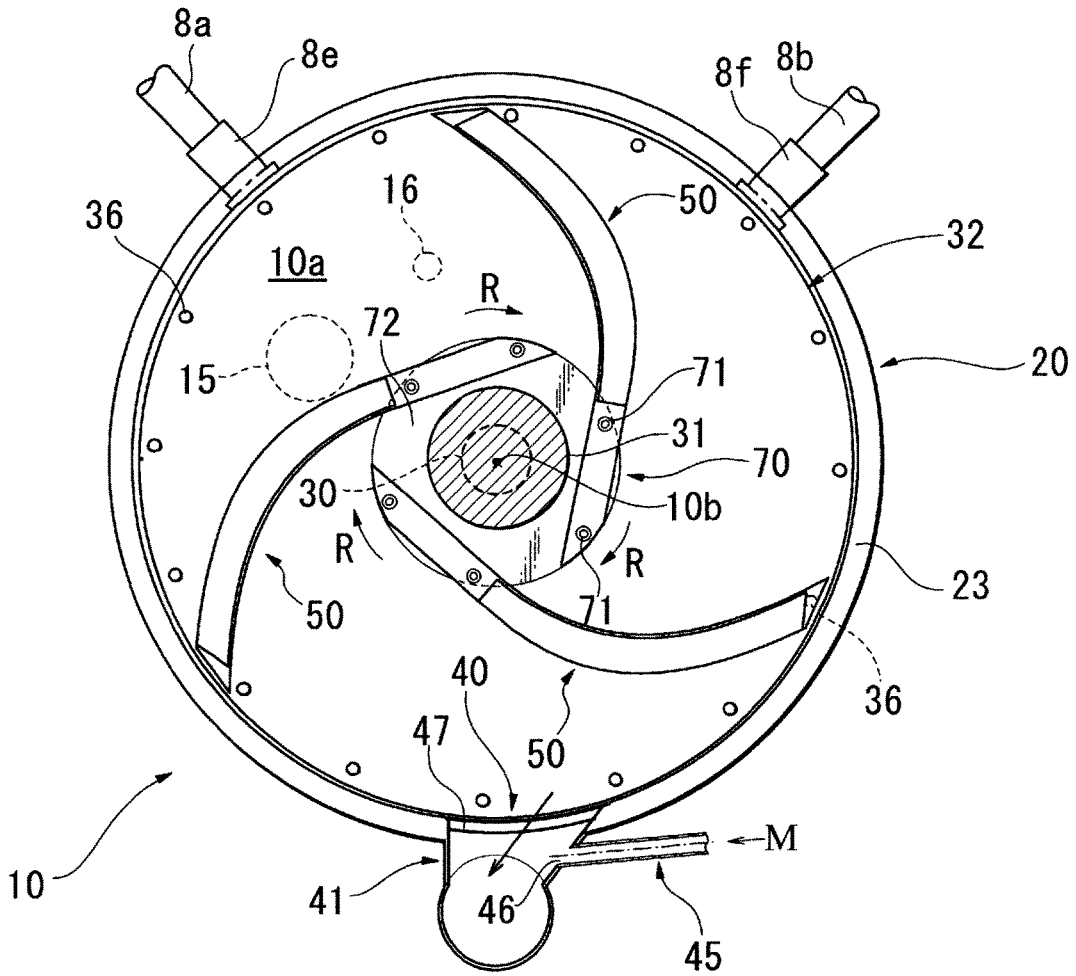

【FIG. 17】
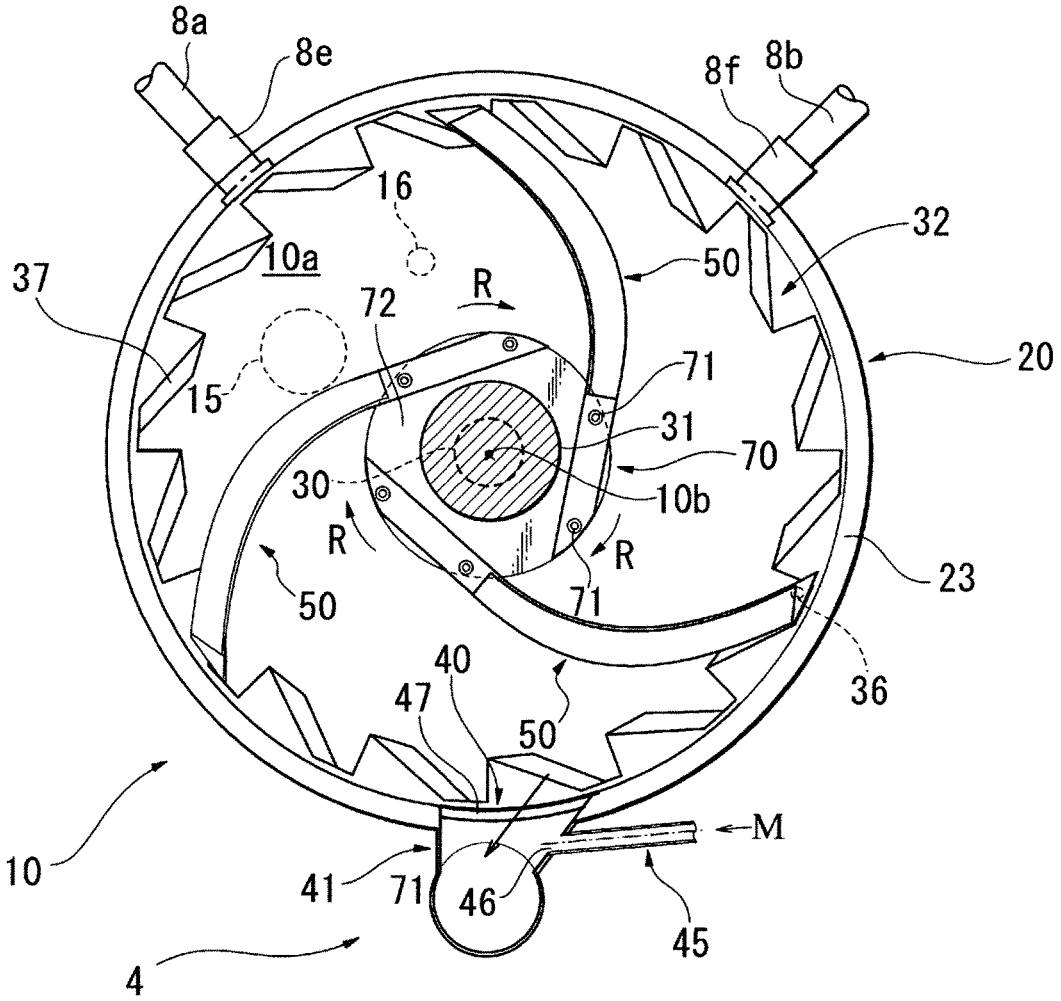

MIXER AND MIXING METHOD FOR GYPSUM SLURRY

CROSS REFERENCE TO RELATED APPLICATIONS

This application is a U.S. National Stage Application, which claims the benefit under 35 U.S.C. § 371 of International Application No. PCT/JP2015/073972, filed on Aug. 26, 2015 and designating the U.S., the entire contents of which are incorporated herein by reference.

TECHNICAL FIELD

The present invention relates to a mixer and mixing method, and more specifically, a scraper-type mixer and mixing method for preparation of gypsum slurry in which a rotary driving device is located above or below a housing and a rotary disc is rotated by a rotary shaft of the rotary driving device extending through an upper or bottom plate of the housing.

BACKGROUND ART

A gypsum board is known as a board having a gypsum core covered with sheets of paper for gypsum board liner. The gypsum boards are widely used in various kinds of buildings as architectural interior finish materials because of their advantageous fire-resisting or fire-protecting ability, sound insulation performance, workability, cost performance and so on. In general, the gypsum boards are produced by a continuous pouring and casting process. This process comprises a mixing and stirring step of admixing calcined gypsum, adhesive auxiliary agent, set accelerator, foam (or foaming agent), and so forth with a quantity of mixing water in a mixer; a forming step of pouring calcined gypsum slurry prepared in the mixer (referred to as "slurry" hereinafter) into a space between sheets of paper for gypsum board liner and forming them into a continuous plate-like belt form; and a drying and cutting step of roughly cutting the solidified continuous belt-like layered formation, drying it forcibly and thereafter, trimming it to be a product size.

Usually, a thin and circular pin-type mixer (also called as a "centrifugal pin-type mixer") is used as the mixer for preparing the slurry in the gypsum board production process and so forth. This type of mixer comprises a flattened circular housing and a rotary disc rotatably positioned in the housing, as disclosed in, for example, PCT Pamphlet of PCT International Application No. WO 00/56435 (Patent Literature 1). A rotary driving device is located above the housing. A rotary shaft of the rotary driving device extends through a center part of the upper cover or upper plate of the housing. The shaft is fixed to a center part of the rotary disc. The upper plate of the housing is equipped with a plurality of upper pins (stationary pins). The upper pins depend from the upper plate down to the vicinity of the rotary disc. The rotary disc is equipped with lower pins (movable pins). The lower pins are vertically fixed on the disc and extend up to the vicinity of the upper plate. The upper and lower pins are arranged in radially alternate positions. A plurality of ingredient feeding ports for feeding the aforementioned materials into the mixer are disposed in a center region of the top cover or upper plate of the housing. The materials to be mixed and kneaded are supplied onto the disc through the respective feeding ports. The materials are mixed and kneaded while being moved radially outward on the disc under an action of centrifugal force. A slurry discharge port for delivering the mixture (slurry) out of the mixer is provided on a periphery of the housing or a lower plate (bottom plate) thereof. The slurry is delivered out of the mixer through the slurry discharge port.

As another type of mixer, a scraper-type mixer is known in the art. This type of mixer stirs the ingredients to be mixed with the use of a rotary disc and a scraper. For example, the mixer as disclosed in Japanese Patent Laid-Open Publication No. 7-1437 (Patent Literature 2) comprises a flattened circular housing and a rotary disc rotatably positioned in the housing, similarly to the pin-type mixer as set forth above. A rotary driving device is located below the housing. A rotary shaft of the rotary driving device extends through a center part of the lower plate (bottom plate) of the housing. The shaft is fixed to a center part of the rotary disc. A scraper is attached to a lower surface of the disc. Furthermore, another scraper is positioned under an upper cover or upper plate, in the vicinity of its underside surface. The upper and lower scrapers rotate together with the rotating disc. The materials to be mixed and kneaded and the mixing water are supplied onto the disc through respective feeding ports of the upper cover or plate. The materials and water are stirred and mixed while being moved radially outward on the disc under an action of centrifugal force, and then, are delivered out of the mixer through a slurry discharge port.

CITATION LIST

Patent Literatures

[Patent Literature 1] PCT Pamphlet No. WO 00/56435
[Patent Literature 2] Japanese Patent Laid-Open Publication No. 7-1437

SUMMARY OF INVENTION

Technical Problem

As described above, the pin-type mixer and the scraper-type mixer are known in the art, as mixers for preparation of the gypsum slurry. The pin-type mixer can mix and knead the gypsum slurry necessarily and sufficiently in a short period of time. Therefore, the strength of set gypsum can be improved. Thus, the pin-type mixer is considered advantageous for ensuring the strength of the set gypsum. For such reasons, the pin-type mixers are used in many production processes for production of gypsum boards, at present.

However, in the pin-type mixer, many pins are attached to the disc. Therefore, the mixer has a large number of mechanical parts. In addition, relatively frequent maintenance and care of the pins, replacement of the pins, and so forth are required because of abrasion or wear of the pins. Thus, costs for maintenance and care are increased and a great deal of manpower is required for replacement of the pins and so forth. This is one of the problems of the pin-type mixer. Furthermore, the many pins are located in the mixing area of the pin-type mixer. Therefore, a relatively large number of narrow regions or dead water regions exist in the mixing area. The slurry tends to stay in such regions. This is another problem of the pin-type mixer, which has been already recognized. Furthermore, the pin-type mixer is considered advantageous for improvement of the strength of the set gypsum. However, a so-called "re-tempering" phenomenon owing to excessive mixing and kneading is apt to occur. This may result in a problem of reduction in the strength of the set gypsum.

On the other hand, the mixing area of the scraper-type mixer has a relatively simple configuration. Therefore, this type of mixer is advantageous for simplification of maintenance and care. In addition, the narrow regions or dead water regions in which the gypsum slurry is apt to stay are hardly generated in the mixing area of the scraper-type mixer. This is advantageous for preventing the stay and adhesion of the slurry in or to the interior of the mixer, and so forth.

As regards the scraper-type mixer, a position of an internal end of the scraper, the number of the scrapers, the orientation and position of the scraper, and so forth have to be designed. Therefore, when designing these matters, it is necessary to take into consideration: a positional interference of the internal end of the scraper, with respect to the rotary shaft, powder inlet port, liquid inlet port; prevention of the stay of the gypsum slurry in a center region of the rotary disc; and so on. Thus, it is very difficult to optimize the number of scrapers, the configuration, orientation and position of the scraper, and so forth in such a manner that a delivery pressure of the slurry is sufficiently obtained by means of centrifugal forces or rotational powers of the rotary disc and the scraper. For instance, the scraper-type mixer as disclosed in Patent Literature 2 has a slurry discharge port positioned on a lower plate. This is because the slurry is discharged from the mixing area, relatively greatly depending on gravity. However, in the arrangement that the slurry is gravitationally discharged, the position of the slurry discharge port is limited to the lower plate (or a lower part of an annular wall in vicinity of the lower plate). Therefore, the positional relationship between the mixer and a production line is limited. This results in loss of design flexibility of a gypsum board manufacturing apparatus.

In the scraper-type mixer, as the position of the slurry discharge port depends on the gravity, retention time of the slurry is relatively short. Therefore, it is difficult to mix and knead the slurry uniformly and sufficiently in the mixing area. Thus, a set slurry mass, which is obtained from the slurry produced by the scraper-type mixer, is considered to hardly exert its sufficient strength. However, according to the studies and findings of the present inventors in recent years, it is possible to uniformly and sufficiently mix and knead the slurry and ensure the desirable strength of the set slurry mass, if the number of the scrapers, the orientation and position of the scraper, and so forth, are appropriately predetermined, and the location of the slurry discharge port is preset in a position mainly depending on the centrifugal forces or rotational powers of the rotary disc and the scraper.

It is an object of the present invention to provide a scraper-type mixer and mixing method that can increase the retention time of the gypsum slurry in the mixing area, whereby the slurry can be sufficiently mixed and kneaded in the mixing area.

Furthermore, it is an object of the present invention to provide a scraper-type mixer and mixing method that can uniformize the density distribution and the velocity distribution of the slurry in the mixing area, whereby the slurry can be uniformly mixed and kneaded in the mixing area.

Furthermore, it is an object of the present invention to provide a scraper-type mixer and mixing method wherein a scraper can be suitably positioned in a housing of the mixer and wherein the slurry discharge port can be positioned in a vertically center region of an annular wall, or at a higher location on the wall.

Solution to Problem

The present invention provides a mixer for preparation of gypsum slurry, which has a circular housing defining a mixing area for mixing and kneading of the gypsum slurry, a rotary disc positioned in the housing and rotated in a predetermined rotational direction, a rotary driving shaft integrally connected with the rotary disc, a scraper positioned in the mixing area, and a slurry discharge port provided on the housing for feeding the gypsum slurry of the mixing area onto a production line;

wherein said rotary driving shaft extends through an upper or lower plate of said housing to be connected with said rotary disc;

wherein an inner end portion of said scraper is positioned in a center region of said rotary disc, an outer end portion of the scraper is positioned in a peripheral zone of the disc, and said slurry discharge port is positioned on an annular wall of said housing; and wherein said slurry discharge port is provided with a fluid passage dividing member which divides an opening of the port into a plurality of narrow openings so as to increase fluid resistance on the gypsum slurry flowing out of said mixing area through said opening of the port.

From another aspect of the invention, the present invention provides a mixing method for gypsum slurry with use of a mixer for preparation of the gypsum slurry, the mixer having a circular housing defining a mixing area for mixing and kneading of the gypsum slurry, a rotary disc positioned in the housing and rotated in a predetermined rotational direction, a rotary driving shaft integrally connected with the rotary disc, a scraper positioned in the mixing area, and a slurry discharge port provided on the housing for feeding the gypsum slurry of the mixing area onto a production line;

wherein an inner end portion of said scraper is positioned in a center region of said rotary disc, an outer end portion of the scraper is positioned in a peripheral zone of the disc, said slurry discharge port is positioned on an annular wall of said housing, and an opening of said slurry discharge port is divided into a plurality of narrow openings so as to increase fluid resistance on the gypsum slurry flowing out of said mixing area through said opening of the port; and wherein said rotary driving shaft extends through an upper or lower plate of said housing, and the shaft rotates said rotary disc and said scraper about a rotational axis of the shaft so that said slurry is mixed and kneaded in said mixing area and the slurry is moved toward the periphery of the mixing area by centrifugal force acting on the slurry, whereby the slurry flows out of said mixing area through said slurry discharge port.

According to the above arrangement of the present invention, the fluid resistance at the slurry discharge port is increased, so that the retention time of the slurry in the mixing area is so extended as to enable sufficient mixing and kneading of the gypsum slurry in the mixing area. Preferably, the opening of the slurry discharge port is divided into a plurality of slits or narrow fluid passages by horizontal, vertical, or lattice guide member. A total area of the slurry discharge port, which includes a fractionation port (or ports), is set to be in a range, preferably, from 2% to 10%, more preferably, from 3% to 8% of a total area of an inner circumferential surface of the annular wall. Furthermore, an open area ratio of the slurry discharge port (including the fractionation port(s)) is set to be in a range, preferably, from 50% to 80%, more preferably, from 55% to 75%.

The present invention also provides a mixer for preparation of gypsum slurry, which has a circular housing defining a mixing area for mixing and kneading of the gypsum slurry, a rotary disc positioned in the housing and rotated in a predetermined rotational direction, a rotary driving shaft integrally connected with the rotary disc, a scraper positioned in the mixing area, and a slurry discharge port provided on the housing for feeding the gypsum slurry of the mixing area onto a production line;

wherein said rotary driving shaft extends through an upper or lower plate of said housing to be connected with said rotary disc; and wherein an inner end portion of said scraper is positioned in a center region of said rotary disc, an outer end portion of the scraper is positioned in a peripheral zone of the disc, and the scraper is bent or curved backward in a rotational direction of the disc between said inner and outer end portions.

From another aspect of the invention, the present invention provides a mixing method for gypsum slurry with use of a mixer for preparation of the gypsum slurry, the mixer having a circular housing defining a mixing area for mixing and kneading of the gypsum slurry, a rotary disc positioned in the housing and rotated in a predetermined rotational direction, a rotary driving shaft integrally connected with the rotary disc, a scraper positioned in the mixing area, and a slurry discharge port provided on the housing for feeding the gypsum slurry of the mixing area onto a production line;

wherein an inner end portion of said scraper is positioned in a center region of said rotary disc, an outer end portion of the scraper is positioned in a peripheral zone of the disc, and the scraper is bent or curved backward in a rotational direction of the disc, between said inner and outer end portions; and wherein said rotary driving shaft extends through an upper or lower plate of said housing, and the shaft rotates said rotary disc and said scraper about a rotational axis of the shaft so that said slurry is mixed and kneaded in said mixing area.

According to the above arrangement of the present invention, the scraper, which is bent or curved backward in the rotational direction, uniformizes the density distribution of the slurry and the fluid velocity distribution of the slurry, respectively, in the mixing area. Therefore, the slurry can be uniformly mixed in the mixing area. For instance, in a case where the scraper is bent in only one position, an angle of a bending part is set to be, preferably, an angle in a range of 45±15 degrees, more preferably, an angle in a range of 45±10 degrees. Preferably, the scraper has a plurality of the bending parts, or the scraper is generally curved, whereby the scraper extends outward from a center area of the mixer, substantially along an involute curve. Preferably, a distal end portion of the scraper is oriented at an angle in a range of 75±15 degrees with respect to a radial direction of the mixing area.

Preferably, an annular basal part is positioned in the mixing area in concentricity with a rotational center of the rotary disc, wherein the annular basal part is rotated integrally with the rotary disc in the housing, and wherein the inner end portion of the scraper is fixed to the annular basal part, so that the scraper is supported horizontally. With such an arrangement, a device, which supports the inner end portion of the scraper, can be ensured in a center part of the rotary disc, so that the inner end portion of the scraper can be firmly supported. Furthermore, the annular basal part prevents a slurry staying region or a dead water region from being formed in the center region of the rotary disc. Therefore, the inner end portion of the scraper can be positioned in the center region of the rotary disc. In addition, the annular basal part improves flexibility in design of the number of the scrapers, orientation and position of each of the scrapers, and so forth. Thus, according to the present invention, a delivery pressure of the slurry can be improved by optimizing the number of scrapers, orientation and position of each of the scrapers, and so forth, and thus, the slurry discharge port can be positioned in a vertically center region of the annular wall or at a higher location on the wall.

More preferably, a center axis of the scraper is oriented in a direction at an angle ranging from 60 degrees to 120 degrees with respect to a line segment passing through a supporting center of the scraper and a center of rotation of the rotary disc. Desirably, a diameter of the annular basal part is set to be three or more times as large as a diameter of the rotary driving shaft, and the inner end portion of the scraper is fixed onto an upper surface of the annular basal part. More desirably, the center axis of the scraper is oriented in a direction perpendicular to the above line segment. According to such an arrangement, the slurry in the mixing area can be energized radially outward of the rotary disc by the scraper; therefore, the slurry discharge port can be provided in an optimized position of the annular wall of the housing.

Preferably, a pin is provided to stand on the periphery of the rotary disc, for augmenting the fluid flow of the slurry flowing out of the mixing area through the slurry discharge port. According to such an arrangement, the delivery pressure of the gypsum slurry can be further increased by the pin, which energizes or pushes the slurry moving to the periphery of the mixing area, in a tangential or radially outward direction of the rotary disc. Furthermore, a distal end portion of the scraper can be positionally matched with the pin and supported by the pin, whereby further stable support of the scraper can be ensured.

In the mixer with the scraper bent or curved backward in the rotational direction, the rotary disc is, preferably, formed with a gear tooth portion on the periphery of the rotary disc, instead of the above pin, for augmenting the fluid flow of the slurry flowing out of the mixing area through the slurry discharge port. According to such an arrangement, the slurry moving to the periphery of the mixing area is energized or pushed in the tangential direction or radially outward direction of the rotary disc by the gear tooth portion and the bent or curved scraper, so that the delivery pressure of the slurry is additionally increased.

Advantageous Effects of Invention

According to the scraper-type mixer and mixing method in which the slurry discharge port is positioned on the annular wall and the opening of the port is divided into the narrow openings for increasing the fluid resistance on the slurry effluent from the mixing area, the retention time of the gypsum slurry in the mixing area can be increased, whereby the slurry can be sufficiently mixed in the mixing area.

Furthermore, according to the scraper-type mixer and mixing method in which the scraper is bent or curved backward in the rotational direction of the rotary disc, the density distribution of the slurry and the velocity distribution of the slurry in the mixing area can be uniformized, whereby the slurry can be uniformly mixed in the mixing area.

Furthermore, according to the scraper-type mixer and mixing method in which the annular basal part is positioned in the mixing area in concentricity with the center of rotation of the rotary disc and the inner end portion of the scraper is fixed to the annular basal part, the scraper can be suitably positioned in the housing of the mixer and the slurry discharge port can be positioned in a vertically center region of the annular wall, or at a higher location on the wall.

BRIEF DESCRIPTION OF THE DRAWINGS

FIG. 1 is an explanatory process diagram partially and schematically illustrating a production process of gypsum boards.

FIG. 2 is a partial plan view of a gypsum board manufacturing apparatus in which an arrangement of a gypsum board production line is schematically illustrated.

FIG. 3 is a plan view illustrating a whole arrangement of a mixer.

FIG. 4 is a perspective view illustrating the whole arrangement of the mixer.

FIG. 5 is a transverse cross-sectional view illustrating an internal structure of the mixer.

FIG. 6 is a fragmentary sectional perspective view showing the internal structure of the mixer.

FIG. 7 includes a transverse cross-sectional view and a partially enlarged cross-sectional view of the mixer, which show a positional relation among a rotary shaft, scrapers, and an annular basal part.

FIG. 8 includes a vertical cross-sectional view and partially enlarged cross-sectional views of the mixer, which show the positional relation among the shaft, the scrapers, and the basal part.

FIG. 9 includes cross-sectional views and a perspective view illustrating a configuration of the scraper.

FIG. 10 includes perspective views and enlarged vertical cross-sectional views showing structures of the slurry discharge port.

FIG. 11 includes transverse cross-sectional views of the mixers showing modifications of the positional relation among the rotary shaft, the scrapers, and the basal part.

FIG. 12 includes transverse cross-sectional views of the mixers, each exemplifying the positional relation between the scraper and the pin.

FIG. 13 is a partially enlarged cross-sectional view of the mixer showing a modification of the annular basal part.

FIG. 14 includes a transverse cross-sectional view and a partially enlarged cross-sectional view of the mixer provided with the scrapers, each of the scrapers being bent at a single bending part, backward in the rotational direction.

FIG. 15 includes a transverse cross-sectional view and a partially enlarged cross-sectional view of the mixer provided with the scrapers, each of the scrapers having a number of bending parts bent backward in the rotational direction.

FIG. 16 is a transverse cross-sectional view of the mixer provided with the scrapers, each of the scrapers being generally curved backward in the rotational direction.

FIG. 17 is a transverse cross-sectional view of the mixer provided with the scrapers, each of the scrapers being curved backward in the rotational direction, and which has a number of gear tooth portions formed in a peripheral zone of the rotary disc.

EMBODIMENT

With reference to the attached drawings, preferred embodiments of the present invention are described hereinafter.

FIG. 1 is an explanatory process diagram partially and schematically illustrating a production process of gypsum boards, and FIG. 2 is a partial plan view schematically illustrating an arrangement of a gypsum board production line.

As shown in FIGS. 1 and 2, a lower sheet of paper 1, which is a sheet of paper for a gypsum board liner, is conveyed along a line of production. The mixer is defined by a scraper-type mixer 10, which is located in a predetermined position in relation to a conveyance line, for example, in a position above the conveyance line. Powder ingredients P (calcined gypsum, adhesive agent, set accelerator, additives, admixture, and so forth) and mixing water L are fed to the mixer 10. The mixer 10 mixes and kneads the powder ingredients P and the mixing water W and prepares slurry (calcined gypsum slurry) 3 to be fed onto the sheet 1 of the production line. The slurry 3 is delivered through a slurry delivery section 4 and a slurry outlet tube 7, and is poured onto a widthwise center area of the sheet 1 (a core area of the gypsum board) through a slurry outlet port 7*a*. A part of the slurry 3 is delivered to fractionation conduits 8 (8*a*, 8*b*) to be poured onto widthwise end portions of the sheet 1 (edge zones of the gypsum board) through slurry outlet ports 8*c*, 8*d*. Into the slurry 3 to be poured onto the widthwise center area, foaming agent or foam M for adjustment of its specific gravity is mixed. The foaming agent or foam M is introduced into the section 4. If desired, the foaming agent or foam M may be fed to the slurry in the fractionation conduits 8.

The sheet 1 is conveyed together with the slurry 3 to reach a pair of forming rollers 18 (18*a*, 18*b*). An upper sheet of paper 2 travels partially around a periphery of the upper roller 18*a* to convert its direction toward a conveyance direction. The diverted sheet 2 is brought into contact with the slurry 3 on the lower sheet 1 and transferred in the conveyance direction substantially in parallel with the lower sheet 1. A continuous belt-like three-layered formation 5 constituted from the sheets 1,2, and the slurry 3 is formed on a downstream side of the rollers 18. This formation 5 runs continuously at a conveyance velocity V while a setting reaction of the slurry proceeds, and it reaches roughly cutting rollers 19 (19*a*, 19*b*). If desired, a variety of forming devices, such as the forming device depending on a passing-through action of an extruder or a gate with a rectangular opening, may be employed instead of the forming rollers 18.

The cutting rollers 19 sever the continuous belt-like layered formation into boards of a predetermined length so as to make boards, each having a gypsum core covered with the sheets of paper, in other words, green boards. The green boards are conveyed through a dryer (not shown) that is located toward a direction shown by an arrow J (on a downstream side in the conveyance direction), whereby the green boards are subjected to forced drying in the dryer. Thereafter, they are trimmed to be boards, each having a predetermined product length, and thus, gypsum board products are produced.

FIGS. 3 and 4 are plan and perspective views illustrating the whole arrangement of the mixer 10, and FIGS. 5 and 6 are a transverse cross-sectional view and a fragmentary sectional perspective view showing an internal structure of the mixer 10.

As shown in FIGS. 3 and 4, the mixer 10 has a flattened cylindrical housing 20 (referred to as "housing 20" hereinafter). The housing 20 has a horizontal disk-like upper plate or top cover 21 (referred to as "upper plate 21" hereinafter), a horizontal disk-like lower plate or bottom cover 22 (referred to as "lower plate 22" hereinafter), and an annular wall or outer circumferential wall 23 (referred to as "annular wall 23" hereinafter) which is positioned in peripheral portions of the upper and lower plates 21, 22. The plates 21, 22 are vertically spaced apart at a predetermined distance, so that an internal mixing area 10*a* for mixing and kneading the powder materials P and the mixing water L is formed in the mixer 10.

A circular opening 25 is formed at a center part of the upper plate 21. An enlarged lower end portion 31 of a vertical rotary shaft 30 extends through the opening 25. The shaft 30 is connected with a rotary driving device (not shown), such as an electric drive motor, and driven in rotation in a predetermined rotational direction (clockwise direction R as seen from its upper side in this embodiment). If desired, a variable speed device, such as a variable speed gear mechanism or a variable speed belt assembly, may be interposed between the shaft 30 and an output shaft of the rotary driving device.

A powder supply conduit 15 is connected to the upper plate 21, for feeding the mixing area 10*a* with the powder ingredients P to be mixed. A water supply conduit 16 is also connected to the upper plate 21, for supplying a quantity of mixing water L to the area 10*a*. If desired, an internal pressure regulator and so forth (not shown) may be further connected to the upper plate 21, for limiting excessive increase in the internal pressure of the mixer 10.

Fractionation ports 8*e*, 8*f*, each of which may be regarded as a kind of slurry discharge port, are provided on the annular wall 23, on the opposite side of the section 4. The fractionation conduits 8*a*, 8*b* are connected to the ports 8*e*, 8*f*, respectively. In this embodiment, the ports 8*e*, 8*f* are positioned, angularly spaced at a predetermined angle $\alpha$ from each other.

A slurry discharge port 40, which constitutes the slurry delivery section 4, is formed on the annular wall 23, angularly spaced at a predetermined angle $\beta$ from the fractionation port 8*f* in the rotational direction R (on the downstream side). The port 40 opens on an inner circumferential surface of the wall 23.

As shown in FIGS. 5 and 6, an enlarged open end of a hollow connecter section 41 is connected to the slurry discharge port 40. The section 41 extends outward from the annular wall 23. A reduced open end of the section 41 is connected to an upper end portion of the slurry delivery tube 42. The tube 42 is a constituent of a mixer, which is usually called a "vertical chute" or "canister." The tube 42 constitutes the slurry delivery section 4 together with the port 40 and the section 41.

A foam-feeding conduit 45 for feeding the foam or foaming agent M to the slurry is connected to a hollow connector section 41. A foam feeding port 46 opens on an internal wall surface of the section 41. The foam or foaming agent M for adjusting the volume of the slurry is fed to the slurry in the section 41 by the conduit 45.

The slurry and foam are introduced through the hollow connector section 41 into a vertical in-chute area (intratubular area) in the slurry delivery tube 42. The slurry and foam turn around the center axis of the tube 42, so that the slurry swirls in the in-chute area of the tube 42. The slurry and foam are subjected to a shearing force so as to be mixed with each other, whereby the foam is uniformly dispersed in the slurry. The slurry in the tube 42 gravitationally flows down in the in-chute area. Then, the slurry is delivered to the widthwise center area of the lower sheet 1 through the slurry outlet tube 7 (FIGS. 1 and 2). The tube 7 is a so-called "boot".

In the housing 20, a rotary disc 32 is rotatably positioned. A lower face of the end portion 31 of the shaft 30 is fixedly secured to a center part of the disc 32. An axis of rotation or a center axis of the disc 32 coincides with the center axis 10*b* of the shaft 30. The disc 32 is rotated with rotation of the shaft 30 in a direction as indicated by the arrow R (clockwise direction).

As shown in FIGS. 5 and 6, a plurality of scrapers 50 are positioned in the housing 20 and angularly spaced at an angular interval of 120 degrees. An annular basal part 70 for supporting internal end portions of the scrapers 50 is formed outside of the lower end portion 31 of the shaft 30. The basal part 70 is integral with the disc 32 and the lower end portion 31, so as to rotate with the shaft 30. The basal part 70 has a horizontal flat upper surface 72. Timer end portions of the scrapers 50 are fixed onto the upper surface 72 of the basal part 70 by fixing tools or anchoring tools 71 such as bolts or screws. Each of the scrapers 50 is supported in a form of a cantilever by the basal part 70. Each of the scrapers 50 extends outward in the mixing area 10*a* to terminate at a position in close proximity to the inner circumferential wall surface of the annular wall 23.

FIGS. 7 and 8 include a transverse cross-sectional view, a vertical cross-sectional view and partially enlarged cross-sectional views showing the positional relation among the shaft 30, the scrapers 50, and the basal part 70.

As shown in FIGS. 7 and 8, the basal part 70 is formed around the lower end portion 31, coaxially about a center axis 10*b* of the disc 32. An external radius r3 of the basal part 70 is set to be two to three times as large as an external radius r1 of the lower end portion 31 (three to five times as large as a diameter of the shaft 30).

As shown in FIG. 8(B), the height h2 of the basal part 70 is smaller than the height h1 of the mixing area 10*a*. An upper surface 72 of the basal part 70 defines a horizontal plane spaced apart from a lower surface of the upper plate 21. For instance, in a case where the mixer 10 has the mixing area 10*a* increased in its volume, the height h1, h2 is increased equally so that the dimension h3 between the upper plate 21 and the upper surface 72 is kept at a constant value. Therefore, the scraper 50 and the upper plate 21 keep their constant positional relation therebetween.

The fixing or anchoring tools 71 for supporting the inner end portion of the scraper 50 are positioned in a pair. As shown in FIG. 7(B), a supporting center 75 of the scraper 50 is positioned between fulcrums defined by the left and right fixing or anchoring tools 71, respectively. A center axis 50*a* of the scraper 50 passes through the supporting center 75. The axis 50*a* extends in a tangential direction with respect to an imaginary perfect circle $\eta$ centered at the center axis 10*b* and having a radius r2. In FIG. 7(B), a normal line $\zeta$ of the circle $\eta$ passes through the center axis 10*b* and the supporting center 75. An angle $\theta$1 between the center axis 50*a* and the normal line $\zeta$ is 90 degrees. The angle $\theta$1 is not necessarily 90 degrees, but the angle $\theta$1 may be set to be, preferably, an angle in a range between 60 degrees and 120 degrees, more preferably, the angle in a range between 75 degrees and 115 degrees. The scraper 50 horizontally extends in a position in close proximity to a lower surface of the upper plate 21. The scraper 50 terminates at a position in close proximity to the inner circumferential wall surface of the annular wall 23.

As shown in FIGS. 8(A) and 8(B), the scraper 50 is supported in the cantilever style by the basal part 7. However, the scraper 50 may be supported in a two-points or a both-ends supporting style by the basal part 7 and a pin 36, as shown in FIG. 8 (C), wherein a distal end portion (a distal end face 59) of the scraper 50 is positionally aligned and connected with the pin 36.

FIG. 9(A) is a cross-sectional view of the scraper 50, FIG. 9(B) is a partial perspective view showing a configuration of the distal end portion of the scraper 50, and FIG. 9(C) is a cross-sectional view showing a modification of the scraper 50.

The scraper 50 has a structure comprising a member 51 formed from a metal and an abrasion-resistant ceramic plate 52 embedded in an upper surface of the member 51. The scraper 50 has a cross-section of an isosceles trapezoid shape, which comprises horizontal upper and lower faces 53, 58, a vertical front and rear faces 54, 55, inclined front and rear faces 56, 57, and the distal end face 59. Inclination angles θ2, θ3 of the inclined faces 56, 57 with respect to the lower face 58 are substantially the same. The upper face 53 is spaced apart at a very small distance S from the lower surface of the upper plate 21. The distance S is set to be a value in a range from 1 to 5 mm. As shown in FIG. 7(A), the end face 59 is oriented approximately in the same direction as the tangential direction of the inner circumferential wall surface of the annular wall 23. The end face 59 is spaced apart at a distance approximately ranging between 5 and 10 mm, from the inner circumferential wall surface of the annular wall 23. If desired, the lower face 58 and the inclined faces 56, 57 of the scraper 50 may be formed as a curved surface 58' that has a generally semicircular or arcuate profile as shown in FIG. 9(C).

As shown in FIG. 8, a scraper 60 is further provided on a lower surface of the disc 32. The scraper 60 is located in the same position as the position of the scraper 50, as seen in the plan view. A lower face of the scraper 60 is spaced apart from an upper surface of the lower plate 22, at a small distance in a range from 1 to 5 mm.

As shown in FIGS. 5 and 6, a disc 32 has a peripheral edge with a perfect circle profile. Pins 36 are vertically fixed on a peripheral zone of the disc 32. The fluid mixture (slurry) of the powder ingredients P and the mixing water L moves outward on the disc 32 under the centrifugal force, and flows through the slurry discharge port 40 to the hollow connector section 41, as shown in the partially enlarged view of FIG. 5. The pin 36 pushes or energizes such a flow of slurry toward a rotational and outward direction. That is, the pin 36 augments the movement of the slurry flowing through the port 40 to the section 41. The port 40, through which the flow of slurry passes, is provided with a plurality of horizontal guide members 47 that divide an opening of the port 40.

FIG. 10(A) is a perspective view showing a structure of the slurry discharge port 40, and FIG. 10(B) is an enlarged vertical cross-sectional view showing a slit configuration of the port 40. FIG. 10(C) and FIG. 10(D) are a perspective view and an enlarged vertical cross-sectional view showing a modification of the port 40.

As shown in FIG. 10(A), the slurry discharge port 40 is provided with the horizontal guide members 47 vertically spaced apart from each other at a uniform interval. Each of the guide members 47 extends in a circumferential direction of the annular wall 23 over the whole width of the port 40. Both ends of each of the guide members 47 are fixed to portions of the wall 23 located on both sides of the port 40. The port 40 is divided into a plurality of narrow openings. The guide members 47 are strips made of metal or resin, each having a square cross-section as shown in FIG. 10(B). For example, each of the guide members 47 has a thickness in a range from 1 to 5 mm and a depth in a range from 5 to 50 mm, in its cross-section. Horizontal slits 48, each having a height in a range from 4 to 15 mm, are formed to be slurry fluid passages between the guide members 47. Such a slits-configuration of the port 40 acts as an orifice, which imposes the fluid resistance on the slurry flowing through the port 40 to the hollow connector section 41, whereby the slits-configuration functions to ensure a retention time of the slurry in the mixing area 10*a*. Such a slits-configuration of the guide members 47 and the slits 48 is also provided on each of the fractionation ports 8*e*, 8*f* which is a kind of the slurry discharge port.

An open area ratio of the slurry discharge port 40 is set to be, preferably in a range from 50% to 80%, more preferably, in a range from 55% to 75%, wherein the open area ratio of the port 40 is defined by "A2/A1", wherein "A1" is the total area of the port 40 along the inner circumferential surface of the annular wall, in other words, "W×T", and wherein "A2" is an effective open area of the slit 48, in other words, "W×t×the number of slits". In the example as illustrated in the figure, "the number of slits" is five. Similarly, the open area ratio of the fractionation port 8*e*, 8*f* is set to be, preferably in a range from 50% to 80%, more preferably, in a range from 55% to 75%, wherein the open area ratio of the port 8*e*, 8*f* is defined by "A4/A3", wherein "A3" is the total area of the port 8*e*, 8*f* along the inner circumferential surface of the annular wall, and wherein "A4" is an effective open area of the port 8*e*, 8*f*.

Furthermore, the total area "A1+A3" of the slurry discharge port 40 and the fractionation ports 8*e*, 8*f* is set to be in a range from 2% to 10%, preferably in a range from 3% to 8%, with respect to the total area of the whole circumferential surface of the annular wall 23 (the diameter of the circumferential wall surface×3.14×the height of the circumferential wall surface).

Alternatively, the horizontal guide member 47 and the horizontal slit 48 may be modified to be a vertical guide member and a vertical slit, or the guide member may be inclined with respect to the fluid direction of the slurry. Furthermore, as shown in FIGS. 10(C) and 10(D), the slurry discharge port 40 and the fractionation ports 8*e*, 8*f* may be divided into a large number of narrow openings by guide members 49 arranged in the form of a lattice, whereby narrow fluid passages 48', each having a square cross-section, are formed therein. Also in such a configuration of the port 40, the open area ratio and so forth is preferably set to be as described above.

FIG. 11 includes transverse cross-sectional views of the mixer 10 showing modifications of the positional relation among the rotary shaft 30, the scrapers 50 and the annular basal part 70.

In the mixer 10 as shown in FIG. 11(A), the four scrapers 50 are oriented in directions angularly spaced apart at an angular interval of 90 degrees from each other. In the mixer 10 as shown in FIG. 11(B), the two scrapers are oriented in directions angularly spaced apart at an angular interval of 180 degrees from each other. If necessary, the five or more scrapers 10 may be provided in the mixing area 10*a* of the mixer 10. If desired, the scrapers 50 may not be spaced at a uniform angular interval, but it is possible to position the scrapers 50 so as to be angularly spaced at unequal angular intervals.

FIG. 12 includes transverse cross-sectional views of the mixer 10, each showing the positional relation between the scrapers 50 and the pins 36.

As shown in each of the figures included in FIG. 12, the scrapers 50 are positioned to be angularly spaced apart from each other, for example, at an angular interval of 120 degrees. The pins 36 are located in positions, preferably, in association with the positions of the scrapers 50. Preferably, the scrapers 50 and the pins 36 are located in rotational symmetry positions with respect to the center axis 10*b* of the rotary shaft 30, as seen in the plan view. For instance, in the layout of the pins 36 as shown in FIG. 12(A), the pins 36 are positioned in the periphery of the rotary disc 32 so as to be angularly spaced apart from each other at an angular interval θa of 120 degrees, in accord with the positions of the scrapers 50. The angular phase of the scrapers 50 and the angular phase of the pins 36 differ from each other by 60 degrees (θa/2). On the other hand, in the layouts of the pins 36 as shown in FIGS. 12(B) and 12(C), the pins 36 are positioned in the periphery of the rotary disc 32 so as to be spaced apart from each other at the angular interval θb of 40 degrees, or the angular interval θc of 30 degrees. The distal end portions of the scrapers 50, which positionally match the pins 36, are supported by the pin 36, as shown in FIG. 8(C). Such a rotational symmetry of the scrapers 50 and the pins 36 prevents pulsation or irregular flow of the slurry from being caused when the slurry flows through the ports 40, 8*e*, 8*f*. This is advantageous for stabilization of the discharge flow rate of the slurry.

FIG. 13 is a partially enlarged cross-sectional view showing a modification of the annular basal part 70.

The annular basal part 70 is not necessarily integral with the rotary shaft 30 and the enlarged lower end portion 31, but the part 70 may be formed with an inner circumferential surface 76 spaced apart from an outer circumferential surface of the portion 31. In FIG. 13, an annular gap 77 having a predetermined width (r4−r1) is formed between the portion 31 with the external radius r1 and the basal part 70 with the internal radius r4.

The operation of the mixer 10 is described hereinafter.

In operation of the rotary driving device, the rotary disc 32 and the scrapers 50 are rotated in the direction R, and the powder ingredients P and the mixing water L to be mixed in the mixer 10 are fed into the mixer 10 through the powder supply conduit 15 and the water supply conduit 16. The powder ingredients P and the mixing water L, which flow into the mixing area 10*a*, are agitated and mixed, and are moved radially outward on the rotary disc 32 under the action of the centrifugal force, until reaching the peripheral zone of the disc 32. The scrapers 50, 60 scrape off or remove the slurry adhered to the lower surface of the upper plate 21 and the upper surface of the lower plate 22. The pins 36 scrape off or remove the slurry adhered to the inner circumferential surface of the annular wall 23.

The slurry reaching the peripheral zone of the mixing area 10*a* is pushed outward and frontward in the rotational direction by the pins 36 and flows through the slurry discharge port 40 to the hollow connector section 41. The foam feeding port 46 of the foam-feeding conduit 45 feeds the slurry with a required quantity of foam or foaming agent M. The slurry including the foam or foaming agent M flows into the slurry delivery tube 42 through the section 41 and is subjected to the rotational power and the shearing force in the tube 42, whereby mixing of the slurry is further progresses. Thereafter, the slurry is delivered onto the widthwise center part of the lower sheet 1 through the slurry outlet tube 7.

The slurry reaching the peripheral zone of the mixing area 10*a* also flows into the fractionation tubes 8*a*, 8*b* through the fractionation ports 8*e*, 8*f*. Such slurry is delivered to the edge zones of the lower sheet 1. For instance, the slurry in vicinity to the ports 8*e*, 8*f* is delivered to the tubes 8*a*, 8*b* without the foam or foaming agent fed to the slurry. Therefore, the slurry fed to the edge zones of the lower sheet 1 has a relatively high specific gravity.

In such an operation of the mixer 10, the scrapers 50 energize the slurry of the mixing area 10*a* radially outward of the rotary disc 32, so as to cause the slurry to be discharged out of the mixing area through the ports 40, 8*e*, 8*f*, in cooperation with the aforementioned action of the pins 36. Since the fluid resistance on each of the ports 40, 8*e*, 8*f* is increased by provision of the aforementioned slits-configuration (or, the lattice configuration or the like), the retention time of the slurry in the mixing area 10*a* is extended. Therefore, the slurry is sufficiently mixed in the mixing area 10*a*.

FIGS. 14-17 are transverse cross-sectional views generally showing the whole arrangements of the mixer 10, each being provided with the scrapers bent or curved backward in the rotational direction. In each of these figures, the constituents or components, which are substantially the same as those in the aforementioned embodiments, are indicated by the same reference numerals.

The scraper 50 as shown in FIGS. 5-13 extends straight from the annular basal part 70, but the scraper 50 as shown in FIG. 14 has a bending part 80 bent backward in the rotational direction. That is, at the bending part 80, a center axis 50*a* of the scraper 50 is bent at an angle θ4 backward in the rotational directions and extends outward therefrom. The scraper 50 terminates at a position in close proximity to the inner circumferential wall surface of the annular wall 23. The center axis 50*a* and a radial direction γ of the mixing area 10*a* intersect at an angle θ5 on the distal end face 59 with each other. Each of the angles θ4, θ5 is set to be, preferably, an angle γ in a range of 45±15 degrees, more preferably, the angle in a range of 45±10 degrees.

The powder supply port of the powder supply conduit 15, which is located on the upper plate 21, is shown as an opening 17 by a dotted line in FIG. 14. As shown in a partially enlarged view of FIG. 14, a center 17*a* of the opening 17 is spaced apart at a distance (a radius) r5 from the center axis 10*b*. The innermost end 17*b* of the opening 17 is spaced apart at a distance (a radius) r6 from the center axis 10*b*. The bending part 80 is spaced apart at a distance (a radius) r7 from the center axis 10*b*. Preferably, a position of the bending part 80 is set to be in a region meeting a condition of r5>r7>r6.

The mixer 10 as shown in FIG. 15 has the scrapers 50 bent backward in the rotational direction, at a number of bending parts 80. The centerline 50*a* of the scraper 50 is bent backward in the rotational direction, at an angle θ6 in each of the bending parts 80. The angle θ6 is set to be, preferably, an angle in a range of 15±10 degrees, more preferably, the angle in a range of 15±5 degrees. At the distal end portion of the scraper 50, the center axis 50*a* is directed toward a direction of the angle θ5 with respect to the radial direction γ of the mixing area 10*a*, wherein the angle θ5 is 75±10 degrees.

The mixer 10 as shown in FIG. 16 has the scrapers 50 generally curved backward in the rotational direction. Preferably, the centerline 50*a* is a curve that extends outward from an outer circumferential edge of the annular basal part 70, substantially in a form of involute curve. Also in the scraper 50 as shown in FIG. 15, the center axis 50*a* bent in a number of the bending parts 80 is, preferably, defined by line segments approximately along an involute curve.

Furthermore, in the mixer 10 as shown in FIGS. 14-16, only one of the distal end portions of the scrapers 50 is positionally matching the pin 36. However, as shown in FIGS. 12(B) and 12(C), it is possible to positionally match all of the distal end portions of the scrapers 50 with the pins 36, thereby supporting all of the distal end portions of the scrapers 50 by the pins 36.

FIG. 17 shows the mixer 10 provided with the rotary disc 32, which has a number of gear tooth portions 37 formed in the peripheral zone of the disc 32, instead of the pins 36. As set forth above, the slurry moving outward on the disc 32 under the centrifugal force flows through the slurry discharge port 40 to the hollow connector section 41, as shown by an arrow in FIG. 17. The gear tooth portions 37 pushes or energizes the flow of slurry toward a rotational and outward direction, in cooperation with the scrapers 50 bent or curved backward in the rotational direction. That is, the gear tooth portions 37 and the scrapers 50 augment the movement of the slurry flowing through the port 40 to the section 41, similarly to the aforementioned action of the pins 36. Therefore, an action similar to the action of the pins 36 augmenting the movement of the slurry can be obtained by such a combination of the gear tooth portions 37 and the scrapers 50.

According to the experiments of the present inventors with respect to the mixer 10 having the aforementioned arrangement, the density distribution and the fluid velocity distribution of the slurry in the mixing area 10*a* are uniformized in a case where the scrapers 50 bent or curved backward in the rotational direction are used, whereby the slurry can be sufficiently mixed and kneaded in a relatively short period of time. The main reasons for this are considered to be as follows:

(1) In a case of the scraper-type mixer, the dead water region or the slurry staying region is hardly generated in the mixing area 10*a*, in comparison with the pin-type mixer;

(2) In a case of the bent or curved scraper 50, the dead water region or the slurry staying region is hardly generated behind the scraper 50 (on the side backward in the rotational direction); and (3) A relatively strong force or pressure directed radially outward of the mixing area 10*a* is given to the slurry by the scraper 50.

Although the present invention has been described as to the preferred embodiments, the present invention is not limited thereto, but may be carried out in any of various modifications or variations without departing from the scope of the invention as defined in the accompanying claims.

For instance, the annular basal part different from the rotary shaft is formed around its enlarged lower end portion in the aforementioned embodiments, but the annular basal part may be formed by additionally enlarging the diameter of the lower end portion of the rotary shaft.

Furthermore, although the pins are arranged in a single-row along the periphery of the rotary disc in the aforementioned embodiments, the pins may be arranged, for example, in double-rows along the periphery of the rotary disc, wherein the pins are provided to stand in pairs, on the periphery of the rotary disc.

Furthermore, the mixer of the present invention may be used for not only production of gypsum boards, but also production of gypsum based boards, such as glass mat boards, or gypsum based boards with glass fiber nonwoven fabric.

INDUSTRIAL APPLICABILITY

The present invention is applicable to a scraper-type mixer and mixing method in which a plurality of scrapers are arranged in a mixing area. According to the mixer and mixing method of the present invention, the retention time of the gypsum slurry in the mixing area can be increased, whereby the slurry can be sufficiently mixed in the mixing area; or the density distribution and the velocity distribution of the slurry in the mixing area can be uniformized, whereby the slurry can be uniformly mixed and kneaded in the mixing area. Thus, the practically remarkable effects can be obtained from the present invention.

LIST OF REFERENCE NUMERALS

10 mixer
10*a* mixing area
10*b* center axis of rotary disc
15 powder supply conduit
16 water supply conduit
20 housing
21 upper plate
22 lower plate
23 annular wall
30 rotary shaft
31 enlarged lower end portion
32 rotary disc
36 pin
37 gear tooth portion
40 slurry discharge port
41 hollow connector section
47, 49 guide member
48 slit
48' narrow fluid passage
50 scraper
50*a* center axis of scraper
70 annular basal part
71 fixing tool or anchoring tool
72 upper surface of annular basal part
75 supporting center
80 bending part

The invention claimed is:

1. A mixer for preparation of gypsum slurry, which has a circular housing defining a mixing area for mixing and kneading of the gypsum slurry, a rotary disc positioned in the housing and rotated in a predetermined rotational direction, a rotary driving shaft extending through an upper or lower plate of the housing to be integrally connected with the rotary disc, and a slurry discharge port provided on the housing for feeding the gypsum slurry of the mixing area onto a production line, comprising:

a scraper which is positioned above said rotary disc in said mixing area formed between the disc and said upper plate, which is spaced apart from an upper surface of the disc, and which is spaced at a small distance from a lower surface of the upper plate for scraping off the slurry from the lower surface of the upper plate; and an annular basal part which is provided on said rotary disc in a center region of the disc so as to rotate integrally with the disc and which is formed to surround a rotational center axis of said rotary driving shaft, wherein an inner end portion of said scraper is fixed to the annular basal part, an outer end portion of the scraper is positioned in a peripheral zone of the disc, and said slurry discharge port is positioned on an annular wall of said housing; and wherein said slurry discharge port is provided with a fluid passage dividing member which divides an opening of the port into a plurality of narrow openings so as to increase fluid resistance on the gypsum slurry flowing out of said mixing area through said opening of the port.

2. The mixer as defined in claim 1, wherein said scraper is bent or curved backward in a rotational direction of the disc, between said inner and outer end portions.

3. The mixer as defined in claim 1, wherein said annular basal part is positioned in concentricity with said rotational center axis.

4. The mixer as defined in claim 3, wherein a diameter of said annular basal part is set to be three or more times as large as a diameter of said rotary driving shaft, and said inner end portion of the scraper is fixed onto an upper surface of the annular basal part.

5. The mixer as defined in claim 1, wherein a center axis of the inner end portion of said scraper horizontally extends in a direction at an angle ranging from 60 degrees to 120 degrees with respect to a line segment passing through a supporting center of the scraper and a center of rotation of said rotary disc.

6. The mixer as defined in claim 1, wherein said dividing member is defined by a plurality of guide members which divide said opening of the slurry discharge port into a plurality of slits, or a meshy or lattice member transversely and vertically dividing the opening of the port.

7. The mixer as defined in claim 1, wherein a pin for augmenting a fluid flow of said slurry flowing out of the mixing area through said slurry discharge port is provided to stand on a periphery of said rotary disc.

8. The mixer as defined in claim 1, wherein a total area of said slurry discharge port is set to be in a range from 2% to 10% of a total area of an inner circumferential surface of said annular wall, and wherein an open area ratio of the slurry discharge port is set to be in a range from 50% to 80% of the total area of the slurry discharge port.

9. A mixer for preparation of gypsum slurry, which has a circular housing defining a mixing area for mixing and kneading of the gypsum slurry, a rotary disc positioned in the housing and rotated in a predetermined rotational direction, a rotary driving shaft extending through an upper or lower plate of the housing to be integrally connected with the rotary disc, and a slurry discharge port provided on the housing for feeding the gypsum slurry of the mixing area onto a production line, comprising:

a scraper which is positioned above said rotary disc in said mixing area formed between the disc and said upper plate, which is spaced apart from an upper surface of the disc, and which is spaced at a small distance from a lower surface of the upper plate for scraping off the slurry from the lower surface of the upper plate; and an annular basal part which is provided on said rotary disc in a center region of the disc so as to rotate integrally with the disc and which is formed to surround a rotational center axis of said rotary driving shaft, wherein an inner end portion of said scraper is fixed to the annular basal part, an outer end portion of the scraper is positioned in a peripheral zone of the disc, and the scraper is bent or curved backward in a rotational direction of the disc between said inner and outer end portions.

10. The mixer as defined in claim 9, wherein said rotary disc is provided with a gear tooth portion for augmenting a fluid flow of said slurry flowing out of said mixing area through said slurry discharge port.

11. The mixer as defined in claim 9 wherein said scraper has a single bending part which bends at an angle in a range of 45±15 degrees, or wherein the scraper is bent at a plurality of the bending parts or generally curved, and a distal end portion of the scraper is directed in a direction of an angle in a range of 75±15 degrees with respect to an radial direction of said mixing area.

12. The mixer as defined in claim 9, wherein said annular basal part is positioned in concentricity with said rotational center axis.

13. The mixer as defined in claim 12, wherein a diameter of said annular basal part is set to be three or more times as large as a diameter of said rotary driving shaft, and said inner end portion of the scraper is fixed onto an upper surface of the annular basal part.

14. The mixer as defined in claim 9, wherein a pin for augmenting a fluid flow of said slurry flowing out of the mixing area through said slurry discharge port is provided to stand on a periphery of said rotary disc.

15. A mixer for preparation of gypsum slurry, which has a circular housing defining a mixing area for mixing and kneading of the gypsum slurry, a rotary disc positioned in the housing and rotated in a predetermined rotational direction, a rotary driving shaft integrally connected with the rotary disc, a scraper positioned in the mixing area, and a slurry discharge port provided on the housing for feeding the gypsum slurry of the mixing area onto a production line:

wherein said rotary driving shaft extends through an upper or lower plate of said housing to be connected with said rotary disc;

wherein an inner end portion of said scraper is positioned in a center region of said rotary disc, an outer end portion of the scraper is positioned in a peripheral zone of the disc, and said slurry discharge port is positioned on an annular wall of said housing;

wherein said slurry discharge port is provided with a fluid passage dividing member which divides an opening of the port into a plurality of narrow openings so as to increase fluid resistance on the gypsum slurry flowing out of said mixing area through said opening of the port; and wherein a pin for augmenting a fluid flow of said slurry flowing out of the mixing area through said slurry discharge port is provided to stand on a periphery of said rotary disc and a distal end portion of said scraper is supported by said pin.

16. A mixing method for gypsum slurry with use of a mixer for preparation of the gypsum slurry, the mixer having a circular housing defining a mixing area for mixing and kneading of the gypsum slurry, a rotary disc positioned in the housing and rotated in a predetermined rotational direction, a rotary driving shaft extending through an upper or lower plate of the housing to be integrally connected with the rotary disc, and a slurry discharge port provided on the housing for feeding the gypsum slurry of the mixing area onto a production line:

wherein a scraper is positioned above said rotary disc in said mixing area formed between the disc and said upper plate, and the scraper is spaced apart from an upper surface of the disc and is spaced at a small distance from a lower surface of the upper plate for scraping off the slurry from the lower surface of the upper plate;

wherein an annular basal part is provided on said rotary disc in a center region of the disc so as to rotate integrally with the disc and is formed to surround a rotational center axis of said rotary driving shaft;

wherein said scraper is horizontally supported by fixing an inner end portion of the scraper to the annular basal part, an outer end portion of the scraper is positioned in a peripheral zone of said rotary disc, said slurry discharge port is positioned on an annular wall of said housing, and an opening of said slurry discharge port is divided into a plurality of narrow openings so as to increase fluid resistance on the gypsum slurry flowing out of said mixing area through said opening of the port; and wherein said rotary driving shaft rotates said rotary disc and said scraper about said rotational center axis so that said slurry is mixed and kneaded in said mixing area and the slurry is moved toward the periphery of the mixing area by centrifugal force acting on the slurry, whereby the slurry flows out of said mixing area through said slurry discharge port.

17. The mixing method as defined in claim 16, wherein said scraper is bent or curved backward in a rotational direction of said rotary disc, between said inner and outer end portions.

18. The mixing method as defined in claim 16, wherein said annular basal part is positioned in concentricity with said rotational center axis.

19. The mixing method as defined in claim 16, wherein a center axis of said inner end portion of the scraper is oriented in a direction at an angle ranging from 60 degrees to 120 degrees with respect to a line segment passing through a supporting center of the scraper and a center of rotation of said rotary disc.

20. The mixing method as defined in claim 16, wherein, as a device for dividing said opening into the narrow openings, a plurality of guide members dividing said opening into a plurality of slits are positioned in said slurry discharge port, or a meshy or lattice member transversely and vertically dividing said opening is positioned in the slurry discharge port.

21. The mixing method as defined in claim 16, wherein a pin is provided to stand on a periphery of said rotary disc, so as to augment a fluid flow of said slurry flowing out of the mixing area through said slurry discharge port.

22. A mixing method for gypsum slurry with use of a mixer for preparation of the gypsum slurry, the mixer having a circular housing defining a mixing area for mixing and kneading of the gypsum slurry, a rotary disc positioned in the housing and rotated in a predetermined rotational direction, a rotary driving shaft extending through an upper or lower plate of the housing to be integrally connected with the rotary disc, a scraper positioned in the mixing area, and a slurry discharge port provided on the housing for feeding the gypsum slurry of the mixing area onto a production line:

wherein a scraper is positioned above said rotary disc in said mixing area formed between the disc and said upper plate, and the scraper is spaced apart from an upper surface of the disc and is spaced at a small distance from a lower surface of the upper plate for scraping off the slurry from the lower surface of the upper plate;

wherein an annular basal part is provided on said rotary disc in a center region of the disc so as to rotate integrally with the disc and is formed to surround a rotational center axis of said rotary driving shaft;

wherein said scraper is horizontally supported by fixing an inner end portion of the scraper to the annular basal part, and the scraper is bent or curved backward in a rotational direction of the disc, between said inner and outer end portions; and wherein said rotary driving shaft rotates said rotary disc and said scraper about said rotational center axis so that said slurry is mixed and kneaded in said mixing area.

23. The mixing method as defined in claim 22, wherein said rotary disc is formed with a gear tooth portion in a periphery of said rotary disc, thereby augmenting a fluid flow of said slurry flowing out of the mixing area through said slurry discharge port.

24. The mixing method as defined in claim 22, wherein said annular basal part is positioned in concentricity with said rotational center axis.

25. The mixing method as defined in claim 22, wherein a pin is provided to stand on a periphery of said rotary disc, so as to augment a fluid flow of said slurry flowing out of the mixing area through said slurry discharge port.

26. A mixing method for gypsum slurry with use of a mixer for preparation of the gypsum slurry, the mixer having a circular housing defining a mixing area for mixing and kneading of the gypsum slurry, a rotary disc positioned in the housing and rotated in a predetermined rotational direction, a rotary driving shaft integrally connected with the rotary disc, a scraper positioned in the mixing area, and a slurry discharge port provided on the housing for feeding the gypsum slurry of the mixing area onto a production line:

wherein an inner end portion of said scraper is positioned in a center region of said rotary disc, an outer end portion of the scraper is positioned in a peripheral zone of the disc, said slurry discharge port is positioned on an annular wall of said housing, and an opening of said slurry discharge port is divided into a plurality of narrow openings so as to increase fluid resistance on the gypsum slurry flowing out of said mixing area through said opening of the port;

wherein said rotary driving shaft extends through an upper or lower plate of said housing, and the shaft rotates said rotary disc and said scraper about a rotational axis of the shaft so that said slurry is mixed and kneaded in said mixing area and the slurry is moved toward the periphery of the mixing area by centrifugal force acting on the slurry, whereby the slurry flows out of said mixing area through said slurry discharge port; and wherein a pin is provided to stand on a periphery of said rotary disc, so as to augment a fluid flow of said slurry flowing out of the mixing area through said slurry discharge port, and a distal end portion of said scraper is supported by said pin.

27. A mixer for preparation of gypsum slurry, which has a circular housing defining a mixing area for mixing and kneading of the gypsum slurry, a rotary disc positioned in the housing and rotated in a predetermined rotational direction, a rotary driving shaft integrally connected with the rotary disc, a scraper positioned in the mixing area, and a slurry discharge port provided on the housing for feeding the gypsum slurry of the mixing area onto a production line:

wherein said rotary driving shaft extends through an upper or lower plate of said housing to be connected with said rotary disc;

wherein an inner end portion of said scraper is positioned in a center region of said rotary disc, an outer end portion of the scraper is positioned in a peripheral zone of the disc, and the scraper is bent or curved backward in a rotational direction of the disc between said inner and outer end portions; and wherein a pin for augmenting a fluid flow of said slurry flowing out of the mixing area through said slurry discharge port is provided to stand on a periphery of said rotary disc and a distal end portion of said scraper is supported by said pin.

28. A mixing method for gypsum slurry with use of a mixer for preparation of the gypsum slurry, the mixer having a circular housing defining a mixing area for mixing and kneading of the gypsum slurry, a rotary disc positioned in the housing and rotated in a predetermined rotational direction, a rotary driving shaft integrally connected with the rotary disc, a scraper positioned in the mixing area, and a slurry discharge port provided on the housing for feeding the gypsum slurry of the mixing area onto a production line:

wherein an inner end portion of said scraper is positioned in a center region of said rotary disc, an outer end portion of the scraper is positioned in a peripheral zone of the disc, and the scraper is bent or curved backward in a rotational direction of the disc, between said inner and outer end portions;

wherein said rotary driving shaft extends through an upper or lower plate of said housing, and the shaft rotates said rotary disc and said scraper about a rotational axis of the shaft so that said slurry is mixed and kneaded in said mixing area; and wherein a pin is provided to stand on a periphery of said rotary disc, so as to augment a fluid flow of said slurry flowing out of the mixing area through said slurry discharge port, and a distal end portion of said scraper is supported by said pin.

* * * * *